US009115492B2

(12) United States Patent
Parham

(10) Patent No.: US 9,115,492 B2
(45) Date of Patent: Aug. 25, 2015

(54) MULTI-FUNCTION STACKABLE CHAIR FOR CONCRETE REINFORCING ELEMENTS

(71) Applicant: BIP Company, LLC, Portland, OR (US)

(72) Inventor: Kerry Parham, Portland, OR (US)

(73) Assignee: BIP COMPANY, LLC, Portland, OR (US)

( * ) Notice: Subject to any disclaimer, the term of this patent is extended or adjusted under 35 U.S.C. 154(b) by 0 days.

(21) Appl. No.: 14/363,298

(22) PCT Filed: Nov. 16, 2012

(86) PCT No.: PCT/US2012/065619

§ 371 (c)(1),
(2) Date: Jun. 5, 2014

(87) PCT Pub. No.: WO2013/074987

PCT Pub. Date: May 23, 2013

(65) Prior Publication Data

US 2014/0311081 A1 Oct. 23, 2014

Related U.S. Application Data

(63) Continuation-in-part of application No. PCT/US2011/061271, filed on Nov. 17, 2011.

(51) Int. Cl.
*E04C 5/16* (2006.01)
*E04C 5/20* (2006.01)

(52) U.S. Cl.
CPC .. *E04C 5/20* (2013.01); *E04C 5/168* (2013.01)

(58) Field of Classification Search
CPC ..... E04C 5/20; E04C 5/167; E04C 5/168
See application file for complete search history.

(56) References Cited

U.S. PATENT DOCUMENTS

| | | | | |
|---|---|---|---|---|
| 3,673,753 | A | 7/1972 | Anderson | |
| 3,788,025 | A | 1/1974 | Holmes | |
| 3,830,032 | A * | 8/1974 | Robb | 52/687 |
| 4,365,736 | A | 12/1982 | Stumm | |
| 4,377,750 | A | 3/1983 | Pape et al. | |
| 4,644,727 | A | 2/1987 | Hanson et al. | |
| 4,835,933 | A | 6/1989 | Yung | |
| 5,107,654 | A | 4/1992 | Leonardis | |
| 5,625,993 | A | 5/1997 | Kelly | |
| 5,729,949 | A * | 3/1998 | Hartzheim | 52/677 |
| 5,893,252 | A | 4/1999 | Hardy, Jr. et al. | |

(Continued)

*Primary Examiner* — Jeanette E Chapman
(74) *Attorney, Agent, or Firm* — Howard Russell

(57) ABSTRACT

Multifunction device for positioning reinforcing materials within poured concrete comprising: an octagon-shaped base, with alternative alignment guides, for supporting the device on a supporting surface, an I-beam, or alternatively back-to-back E-beam, construction post with struts extending to the base, and a multifunction clip comprised of a saddle having a plurality of uprights extending therefrom and defining orthogonally-oriented sockets of differing dimensions adapted for clipping onto and positioning reinforcing materials a pre determined distance above the supporting surface. The multifunction clip further comprises means for allowing biasing of the uprights adapted for insertion and releasable retention of reinforcing materials in the sockets, the uprights of the multifunction clip further comprise attachment prongs, and the base of each multifunction device preferably comprises receptacles adapted for allowing alternative interconnected stacking of a plurality of the same identical devices for layered reinforcing of thicker concrete pours.

5 Claims, 15 Drawing Sheets

(56) References Cited

U.S. PATENT DOCUMENTS

| | | | | |
|---|---|---|---|---|
| 5,937,604 | A | 8/1999 | Bowron | |
| 6,276,108 | B1 * | 8/2001 | Padrun | 52/684 |
| 6,663,316 | B1 * | 12/2003 | Harris | 404/136 |
| 6,883,289 | B2 | 4/2005 | Juedes et al. | |
| 7,322,158 | B1 * | 1/2008 | Sorkin | 52/685 |
| 7,461,491 | B1 * | 12/2008 | Sorkin | 52/685 |
| 7,810,298 | B1 * | 10/2010 | Sorkin | 52/685 |
| 7,866,114 | B2 | 1/2011 | De La Cruz | |
| 8,099,925 | B1 * | 1/2012 | Coons | 52/686 |
| 2004/0031228 | A1 | 2/2004 | Hardy, Jr. et al. | |
| 2004/0261352 | A1 * | 12/2004 | Bennett et al. | 52/698 |
| 2005/0005564 | A1 * | 1/2005 | Bennett et al. | 52/677 |
| 2008/0028717 | A1 | 2/2008 | Sorkin | |
| 2009/0007500 | A1 | 1/2009 | Boots | |
| 2011/0214381 | A1 * | 9/2011 | Alfonso | 52/685 |
| 2012/0247058 | A1 * | 10/2012 | Alfonso | 52/686 |

* cited by examiner

MULTI-FUNCTION STACKABLE CHAIR FOR CONCRETE REINFORCING ELEMENTS

CROSS-REFERENCE TO RELATED APPLICATIONS

This application is a continuation-in-part of PCT Application PCT/US 11/6127, filed 17 Nov. 2011 and which claims the benefit of U.S. Provisional Application No. 61/526,141, filed 22 Aug. 2011. This application claims the benefit of that PCT Application PCT/US 11/61271.

FIELD

This invention relates generally to reinforcement of poured concrete, and more specifically to devices for holding concrete reinforcing materials in a fixed position while the concrete is poured around them.

BACKGROUND

Reinforcing elements for poured concrete, such as steel rebar or wire frame mesh, are relatively heavy and require support from what are known in the industry as chairs and clips. In the case of rebar, the reinforcing elements are often laid out in a grid with longitudinally extending bars intersecting, typically at 90-degree angles, with other bars. At the intersection points, the bars are preferably connected together, or tied with wire, or clips, and supported by chairs at a pre-determined height from the supporting surface, such as the ground, or preferably a compacted aggregate for a poured pad, provided as a base for the poured concrete. In the case of wire mesh, the reinforcing elements are already welded together at the points of intersection, so there is no need to tie each intersection together manually with a clip, though there often is the need to tie a sheet of mesh to other sheets of mesh. Thus, the primary objective of such a device as used with wire mesh is to clip to and support the wire mesh on the supporting surface.

Prior means for supporting and tying rebar has literally included blocks and bailing wire, respectively. In more recent times there have been developed devices particularly suited for the purpose of supporting and connecting rebar or supporting wire mesh. For example, U.S. Pat. No. 5,107,654 to Leonardis discloses a support chair for supporting reinforcement for foundations in which there is a turret shape and a lower base, the turret shape having a plurality of upwardly open slots into which the reinforced rods may be located, the shape of each of the slots being such as to provide for interlocking of each rod particularly by providing a narrower part of the slot through which the rod must squeeze to a lower wider part. As another example, U.S. Pat. No. 3,788,025 to Holmes likewise discloses a chair for supporting in right angular relation two reinforcing rods used in construction and comprising a lower arched base part and an upper rod supporting part. Leonardis and Holmes provide a device for support and tying of rebar or support of mesh of a single particular size, but not of two different sizes using the same device. Further, neither Leonardis nor Holmes makes provision for easy stacking and interconnection of multiple of the same type of chairs.

Another prior device used to interconnect rebar at normal intersections of the rebar, one rebar positioned above another, is found in U.S. Pat. No. 6,276,108 to Padrun, which teaches a device for supporting and connecting reinforcing elements for concrete structures comprising a circular base adapted to rest on a supporting surface, an upright post extending from the base, and a clip mounted on the post having a pair of orthogonal sockets engagable with two horizontally extending reinforcing elements, such as rebar, for connecting the elements together at right angles to each other and holding the elements a predetermined distance above the supporting surface. Padrun also discloses and claims a plurality of tapered vanes extending upwardly from the base and intersecting along a centerline of the device for supporting the post in supporting the clip for holding the reinforcing elements. Thus, Padrun provides a device for support and tying of rebar or support of mesh of a single particular size, but not of two different sizes using the same device. Further, Padrun does not make provision for easy stacking and interconnection of multiple of the same type of chairs.

U.S. Pat. No. 5,937,604, to Bowron, discloses a concrete form wall spacer for supporting a plurality of concrete reinforcing materials relative to each other within a wall. Bowron also discloses an embodiment that includes removable clips from a primary truss structure to allow customization of the device for supporting reinforcing materials. Bowron does not disclose a singular device capable of accommodating multiple cross-section sizes of reinforcing materials that is also stackable on another such singular device, and having the same identical configuration as the first device, for the purpose of supporting the reinforcing materials in multiple levels on a base for a thicker concrete pour.

U.S. Pat. No. 4,644,727 to Hanson et al. discloses a strand chair for supporting pre-stressing cable of one cross-section dimension and cross-mesh of another cross-section dimension, in an elongated precast concrete plank. However, as it discloses at least two different configuration parts for stacking, Hanson does not disclose a single device capable of stacking on itself to accomplish multiple levels of support for thicker concrete pours.

U.S. Pat. No. 7,810,298 to Kelly discloses a pair of stackable paving risers for supporting rebar in stacked and/or intersection relationship. With Kelly, an upper riser is disclosed having an extra clip member specially adapted for interconnecting a bottom portion of the upper riser to a top portion of a lower riser. The lower riser of Kelly does not include this extra clip member adapted for interconnecting the two risers. Accordingly, Kelly does not disclose a single chair capable of stacking on itself.

Strength and stability of the supporting chairs and clips is at a premium, since the chairs and clips must be strong and stable enough to withstand the weight of the rebar and wire mesh. Further, oftentimes workers walk on the framing structure of the tied and supported reinforcing materials, adding to the amount of weight that the chair and tie devices supporting the reinforcing materials must be able to withstand. Still further, the process of constructing a reinforcing framework for poured concrete is often awkward, requiring a lot of lifting of materials by workers, moving, tying and the like. As sometimes heavy bars or other materials are dragged across the framework, it is not uncommon for the chairs to tip over or even collapse or buckle under the weight of the load.

Also, from time to time there has been a need to pick up the reinforcing elements to move them after they have been placed in prior art supporting devices. For these reasons, and because other shifting can cause the reinforcing element to become dislodged from the chair or clip, the Leonardis and Padrun disclosures teach gripping of the reinforcement elements. This allows that the support chair and clip will be moved with the reinforcing elements as they are moved. Nevertheless, this also contributes to the need for stability, durability and strength of the devices, as shifting, tipping, and re-positioning of the entire framework could lead to some slight movement out of perfect alignment of one or more supporting devices.

Compounding the problems mentioned above associated with strength and stability of chairs, often times it has been desirable to have multiple layers of reinforcements stacked, as it were, for reinforcing thicker concrete pours. In such cases the bottom layer of chairs has been required to withstand the stress of two or more layers of reinforcing materials, as well as the weight of workers from time to time. Such chairs have been made of a relatively rigid yet deformable plastic in the past. There is a manifest need over the prior art for a light-weight, but sturdy and somewhat deformable, design of chair capable of strength to securely retain heavy and unwieldy concrete reinforcing members in place, yet pliable enough to admit the retaining members within a clip portion of the chair but also allow removal of the chair as may be necessary.

There are a relatively large number of sizes and combinations of chairs and clips on the market associated with differing diameters of rebar and mesh, as well as for differing heights for various thicknesses of concrete pours. For example, it is not uncommon in the industry for there to be #4, #5 and #6 rebar, corresponding to ½ inch, ⅝ inch, ¾ inch rebar, and larger sizes as well, together with chairs designed for positioning the rebar, or mesh, at the middle of a pour that is two, three, four, five, six or eight inches in depth. Thus, to be efficient, it would be desirable to simplify the number of devices from which to choose. The prior art has not provided a single device that is multifunctional in that it allows support and tying of two pieces of rebar, or alternatively, clipping onto and support of wire mesh, all at the appropriate height for the particular reinforcement material in use.

When used for reinforcement of concrete used in tilt-up construction, some prior art reinforcement support devices have also had the undesirable feature that when the dried and cured concrete has been tilted up to form a wall of the structure, the bases of the reinforcing material supporting devices have been visible on the exterior of the wall. This has caused an unsightly appearance on the surface of the wall and has also made final finishing of the wall more difficult.

SUMMARY

Responsive to the needs presented by the industry having encountered prior art devices, in accordance with a first aspect of the invention, there is provided a sturdy and stable multifunction device adapted for releasably gripping and positioning one of reinforcing mesh wire having a first cross-section dimension and a plurality of other reinforcing materials having a second cross-section dimension. The multifunction device of this aspect of the invention comprises: a base adapted for resting on a supporting surface; a central post having first and second ends and extending from the base at the first end; a multifunction clip attached at the second end of the post and defining a first socket of a first dimension adapted for clipping onto and positioning of a reinforcing material of a first cross-section dimension a pre-determined distance above the supporting surface, the multifunction clip further defining a pair of orthogonally oriented sockets of a second dimension and adapted for connecting at right angles and positioning reinforcing materials having a corresponding second cross-section dimension a pre-determined distance above the supporting surface; and means for allowing biasing of the multifunction clip so that it is adapted for insertion and releasable retention of reinforcing materials.

The post in accordance with this aspect of the invention comprises a vertically-oriented I-beam member that widens angularly at below a midpoint of the post into angular supporting struts interconnecting the post with an octagonal-shaped base, the struts preferably intersecting the octagonal-shaped base near opposing straight edge portions of the octagon.

Preferably, the multifunction clip of the multifunction device further comprises a saddle portion attached at the second end of the post and preferably still further comprises a plurality of generally upright poles, or standards having a plurality of angular and circular variations therein and referred to hereinafter as uprights, extending upwardly away from the saddle portion and the post. The uprights of such a multifunction clip define the first and second sockets, and the means for allowing biasing of the multifunction clip further comprises a hole defined adjacent the saddle portion of the multifunction clip. Thus, the means for biasing the multifunction clip, for allowing the uprights to be adapted for being forced or expanded outwardly from a pre-installation first position to a second position during installation where the uprights are spread sufficiently midway during receipt of a reinforcing element, is the hole defined adjacent the saddle portion. The uprights of the multifunction clip are adapted for then returning to the pre-installation first position around the reinforcing element as the reinforcing element moves into fully engaged positioned within the socket formed by the uprights.

The reinforcing material support and positioning device of this aspect of the invention provides a more stable and sturdy base and support than that offered by the prior art for heavy rebar support, or alternatively wire mesh, that are otherwise prone to tipping. The I-beam construction of the post of the device, together with the I-beam struts thereof, have proven more sturdy and capable to resist torsional, as well as compression, forces than prior art devices. These features, in concert with the octagonal-shaped base, work together to provide greater stability for supporting heavy loads during the often awkward process of constructing a rebar, or wire mesh, framework. The device of this aspect of the invention, capable of accommodating normally oriented, i.e., orthogonally oriented supporting material, or rebar, of a first cross-section dimension, or alternatively other supporting material, such as wire mesh of a different cross-section dimension, is preferably comprised of single unitary construction comprising a lightweight material such as rigid, but resiliently deformable, plastic, such as acrylonitrile butadiene styrene (ABS) plastic, or preferably polyoxymethylene (POM) plastic, for allowing installation of the device, or alternatively removal of the device from the supporting material.

In busier concrete pouring operations there is recognized the benefit of having a single supporting and tying chair/clip combination that supports either rebar, securely gripping and tying/clipping two pieces of rebar together, or alternatively wire mesh, all by using the same, multifunctional device. Having such a chair/clip available would be convenient and save time, since workers would not have to choose from as many devices given the particular job at hand. Further, this makes easier the ordering of materials for a particular job.

It will be appreciated that the present invention is capable of being used to either grip, support and interconnect rebar, or grip and support wire mesh, depending upon the needs of the job. Thus, in either case, whether used with rebar or with wire mesh, the device grips the reinforcing material so that movement of the material after installation of the device does not present any problems with the device falling off of the framework into near the bottom of where the concrete is to be poured.

In accordance with another aspect of the invention, a plurality of identical reinforcement support devices are adapted for being stacked on top of each other for supporting thicker concrete pours. Each of the multifunction clips in accordance with this aspect of the invention further comprise attachment means, and each of the bases further comprise an attachment area, the attachment means and the attachment areas being adapted for interconnecting the multifunction clip of one multifunction reinforcing materials support device to a base of another multifunction device to allow interconnecting and stacking of a plurality of multifunction devices.

More specifically, preferably each of the uprights of each multifunction clip are able to be biased inwardly relative to each of the other uprights, and each of the uprights further comprises an attachment prong at the tip of each upright furthermost from the saddle and central post. The attachment area of the base element of the multifunction device comprises a plurality of corresponding attachment receptacles, one receptacle for each upright/prong combination, each attachment receptacle being adapted for receiving the attachment prong of the upright corresponding to the receptacle in releasably engagable fashion to allow interconnecting and stacking of a plurality of multifunction devices.

This aspect of the invention enhances the convenience, ease of use and versatility of the device to be used for thicker concrete pours, since the same device may be used for the first layer of rebar, or mesh, as for the second layer of rebar or mesh. Further, this aspect of the invention provides for interconnection of each of the layers of reinforcing materials to create a sturdy and stable structure in which the concrete may be poured.

This aspect of the invention further underscores the importance of the enhanced-strength I-beam support structure for the post of the device, since subsequent layers of reinforcement material adds more weight to be supported by the lower layers. Further, it will be appreciated that there may also exist a need for the device to support the weight of multiple workers on the resulting concrete reinforcement structure built with a plurality of devices in accordance with the present invention. Since the device is made of plastic so as to be lightweight, easy to store and easy and cost-effective to ship, the stronger I-beam design and construction of the device is important to resist the compressive and torsional forces to which the device is subjected, especially in the case of needed multiple layers of reinforcement materials for thicker concrete pours.

In accordance with still another aspect of the invention, an alternate embodiment of the invention is provided for use with tilt-up construction wherein the base comprises a plurality of base legs for supporting the post on the supporting surface, the base legs extending diagonally and downwardly from the first end of the post and terminating where each base leg is adapted for making minimal contact with the supporting surface, such as would be the case where the base leg tapers to a small point at the location where the base leg rests upon the supporting surface. With this embodiment of the invention, the reinforcement material supporting device is virtually completely enclosed in concrete after the concrete is poured and cured. Thus, when the slab of concrete is tilted up to form a wall of a building, the base member elements of each of the reinforcement support devices is not visible on the outside of the wall. This eliminates an unsightly and problematic condition left by exposure on the outside of the tilt-up wall of the bases of some prior art devices.

In accordance with yet another aspect of the invention, another alternate embodiment of the invention is provided wherein a phosphorescent material is added to the plastic to make the multifunction device more visible during adverse lighting conditions.

In accordance with another aspect of the invention there is provided an alternate embodiment of the invention comprising yet a more sturdy and stable multifunction device adapted for releasably gripping and positioning one of reinforcing mesh wire having a first cross-section dimension and a plurality of other reinforcing materials having a second cross-section dimension. The multifunction device of this aspect of the invention comprises: a reduced-material base adapted for resting on a supporting surface; a central E-beam construction post having first and second ends and extending from the base at the first end; an enhanced sturdiness multifunction clip attached at the second end of the post and defining a first socket of a first dimension adapted for clipping onto and positioning of a reinforcing material of a first cross-section dimension a pre-determined distance above the supporting surface, the multifunction clip further defining a pair of orthogonally oriented sockets of a second dimension and adapted for connecting at right angles and positioning reinforcing materials having a corresponding second cross-section dimension a pre-determined distance above the supporting surface; and means for allowing biasing of the multifunction clip so that it is adapted for insertion and releasable retention of reinforcing materials.

Preferably the post comprises a vertically-oriented, back-to-back E-shaped beam member the cross-section of which is shaped like two capital E's, back-to-back i.e., having a central webbing member comprised of the "two backs of the capital E-shaped cross-section structure, two outer fin-like members on each side, or end in cross section view, of the central webbing member, and an inner fin-like member between the two outer fin-like members. The back-to-back E-shaped beam member widens angularly at below a midpoint of the post (i.e., approximately at about ⅔ rds of the way down from the top of the post) into angular supporting struts formed by each of the two outer fin-like members and interconnecting the post with an octagonal-shaped base, the struts preferably forming intersections with the octagonal-shaped base in a manner parallel to and near opposing straight edge portions of the octagonal base, and with each of the inner fin-like members intersecting the octoganal-shaped base likewise parallel to the aforementioned strut intersections such that each inner fin-like member points in perpendicular fashion to opposing straight edge portions of the octagon-shaped base member that are at right angles to the aforementioned opposing straight edge portions adjacent the strut member intersections.

Preferably, the multifunction clip of the multifunction device further comprises a saddle portion attached at the second end of the post and preferably still further comprises a plurality of generally upright poles, or standards having a plurality of angular and circular variations therein and referred to hereinafter as uprights, extending upwardly away from the saddle portion and the post. The uprights of such a multifunction clip of this alternate embodiment of the invention are generally thicker in girth than the first embodiment of the invention described herein. The uprights define the first and second sockets, and the means for allowing biasing of the multifunction clip further comprises a hole defined adjacent the saddle portion of the multifunction clip. Thus, the means for biasing the multifunction clip, for allowing the uprights to be adapted for being forced or expanded outwardly from a pre-installation first position to a second position during installation where the uprights are spread sufficiently midway during receipt of a reinforcing element, is the hole defined adjacent the saddle portion. The uprights of the multifunction clip are adapted for then resiliently returning to the pre-installation first position around each reinforcing element as the reinforcing element moves into fully engaged positioned within the socket formed by the uprights during installation.

The reinforcing material support and positioning device of this aspect of the invention provides an even further stabilized and sturdy base and support than that offered by the prior art for heavy rebar support, or alternatively wire mesh, that are otherwise prone to tipping. The back-to-back E-beam construction of the post of the device, together with the E-beam struts thereof, have proven more sturdy and capable to resist torsional, as well as compression, forces than prior art devices. These features, in concert with an enlarged octagonal-shaped base over other embodiments of the invention, work together to provide greater stability for supporting heavy loads during the often awkward process of constructing a rebar, or wire mesh, framework. The device of this aspect of the invention, capable of accommodating normally oriented, i.e., orthogonally oriented supporting material, or rebar, of a first cross-section dimension, or alternatively other supporting material, such as wire mesh of a different cross-section dimension, is preferably comprised of single unitary construction comprising a lightweight material such as rigid, but resiliently slightly deformable, acrylonitrile butadiene styrene (ABS) plastic, or preferably polyoxymethylene (POM) plastic, for allowing installation of the device, or alternatively removal of the device, from the supporting material.

As with previous embodiments of the invention, the device of this aspect of the invention is appreciated in busier concrete pouring operations where there is recognized the benefit of having a single supporting and tying chair/clip combination that supports either rebar, securely gripping and tying/clipping two pieces of rebar together, or alternatively wire mesh, all by using the same, multifunctional device. Having such a chair/clip available would be convenient and save time, since workers would not have to choose from as many devices given the particular job at hand. Further, this makes easier the ordering of materials for a particular job.

As with previous aspects of the invention, this aspect of the present invention is capable of being used to either grip, support and interconnect rebar, or grip and support wire mesh, depending upon the needs of the job. Thus, in either case, whether used with rebar or with wire mesh, the device grips the reinforcing material so that movement of the material after installation of the device does not present any problems with the device falling off of the framework into near the bottom of where the concrete is to be poured.

As with other aspects of the invention, the embodiment in accordance with this aspect of the invention is usable as a plurality of identical reinforcement support devices adapted for being stacked on top of each other for supporting thicker concrete pours. Each of the multifunction clips in accordance with this aspect of the invention further comprise attachment means, and each of the bases further comprise an attachment area, the attachment means and the attachment areas being adapted for interconnecting the multifunction clip of one multifunction reinforcing materials support device to a base of another identical multifunction device to allow interconnecting and stacking of a plurality of identical multifunction devices.

More specifically, preferably each of the uprights of each multifunction clip are able to be biased inwardly relative to each of the other uprights, and each of the uprights further comprises an attachment prong at the tip of each upright furthermost from the saddle and central post. The attachment area of the base element of the multifunction device comprises a plurality of corresponding attachment receptacles, one receptacle for each upright/prong combination, each attachment receptacle being adapted for receiving the attachment prong of the upright corresponding to the receptacle in releasably engagable fashion to allow interconnecting and stacking of a plurality of multifunction devices.

Further in accordance with this aspect of the invention, there are provided enhanced shelf areas with increased material angular supports undergirding the enhanced shelf areas to secure interconnection of the two identical chair members in stacking relationship, one chair on top of another chair. The enhanced shelf areas with increased material angular supports undergirding the enhanced shelf areas enable enhanced support capability of the device of this aspect of the invention for increased loads presented by the upper layer of reinforcing materials involved in this stacking scenario. Further, the enhanced material of the uprights of this invention furthers previous aspects of the invention to enable a more sturdy retention of concrete reinforcement materials, while still incorporating design features, such as reinforcement entry ways and guides into gripping sockets having upper retention means portions and deformable material and means for allowing opening and closing of the clip portion of the device enabling easy installation and relatively easy removal if necessary to reposition the device.

Still further, the multifunction device in accordance with this aspect of the invention, comprises an underside base member area having partially hollowed-out portions of the underside surface area so as to reduce cost of production of the device, while still retaining the rigidity and sturdiness of other aspects of the invention associated with remaining thicker portions of the base. This feature of this aspect of the invention further facilitates secure placement of the device on the ground or aggregate surface, since the ridge-like transition areas, or edge areas, between the thicker and thinner portions of the underside surface serve to hold the device in place with each edge conforming shelf-like to where it has been placed upon the ground or aggregate surface. Thus, the ridge-like transition areas dig into the surface when the heavy weight of the reinforcing materials is added to the chair, which in turn causes the edge like features of the underside of the base of this embodiment of the invention to dig in slightly, or conform to and with the slightly deformable supporting surface to create a more stable base for the resulting structure.

In accordance with another aspect of the invention, to further facilitate ease of use of the device in accordance with this aspect of the invention, there are further provided in the octagonal base area of the device a plurality of punched-through alignment guide arrows for guiding a user in the proper orientation of the device for placement on the ground. These punched-through arrows easily signify to the user the need to place the device with the arrows oriented in parallel alignment to the longitudinal axis of the lower piece of rebar to be placed and held in the device. Further, in terms of aligning two devices for easy stackability, the punched-through arrows also guide the user in aligning two identical devices for stacking, the devices being attachable in the orientation wherein the arrows of each of the devices are aligned with each other, with one device in such position able to be stacked on top of the other. If the arrows of two identical such multifunction devices in accordance with this aspect of the invention are oriented normal to each other, the devices will not readily attach to each other. Another function and advantage of these punched-through alignment guide arrows is that they enable the concrete to flow through them, and minimize the amount of material necessary to form the device, thus allowing for greater structural integrity of the final pour of concrete, as well as a less costly chair to produce preferably with plastic injection molding manufacturing means. Thus, these punched-through arrows serve multiple purposes in facilitating manufacture and use of the invention.

Further in accordance with this aspect of the invention, similar alignment guide arrows are placed on the tilt-up, pointed-base, embodiment of the present invention to assist a user in properly orienting that embodiment of the invention along the longitudinal axis of the lower piece of rebar to be supported in the device. The alignment guide arrows of either embodiment of the invention may be punch-through alignment guides, as shown in FIG. 8, or raised as shown in FIG. 13. However for strength of support reasons, build up alignment guides are preferred in the tilt-up wall construction adapted embodiment of the invention shown and described hereafter in connection with in FIG. 13, whereas for strength of resulting concrete pour reasons, punch through alignment guides are preferred for the octagon-shaped base embodiments of the invention.

Thus, there is provided such a multifunction device, wherein the base further comprises an octagonal-shaped disk having four pairs of opposing parallel edges, wherein the back-to-back E-shaped beams intersect with the base forming linear intersections that preferably are each parallel to two opposing edges of the base. Preferably, these linear intersections are comprised of two outer parallel intersections, one inner parallel intersection and a perpendicular interconnecting intersection, wherein the alignment guides are interposed between each of the outer parallel intersections and their closest parallel edge portions of the octagonal base with a pointer of each alignment guide pointing outwardly towards the nearest edge of the base. Still further, preferably, the alignment guides are punched through alignment guides allowing for easy alignment of devices and flow through of concrete to enhance the strength of the resulting pour.

Methods of installation of a device in accordance with the present invention are disclosed comprising the steps of: aligning a first rebar reinforcing element with a first opening in a multifunction clip retained on a post extending from a base member, pressing the first rebar reinforcing element into a lower socket of the multifunction clip, aligning a second rebar reinforcing element with another opening in the multifunction clip that is normal to the first opening and forcing the second rebar into an upper socket of the multifunction clip. Alternatively, a method of installing a device in accordance with the present invention on wire mesh is disclosed comprising the steps of aligning a segment of the wire mesh with an opening in a multifunction clip retained on a post extending from a base member, passing the mesh segment through an upper socket designed for holding a larger diameter reinforcing element and forcing the wire mesh segment into a lower socket of the multifunction clip designed for retaining the wire mesh reinforcing element. Still further, alternatively, the device itself may be pressed onto a piece of rebar or wire mesh.

The subject matter of the present invention is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

DESCRIPTION OF EMBODIMENTS

Figure 1:
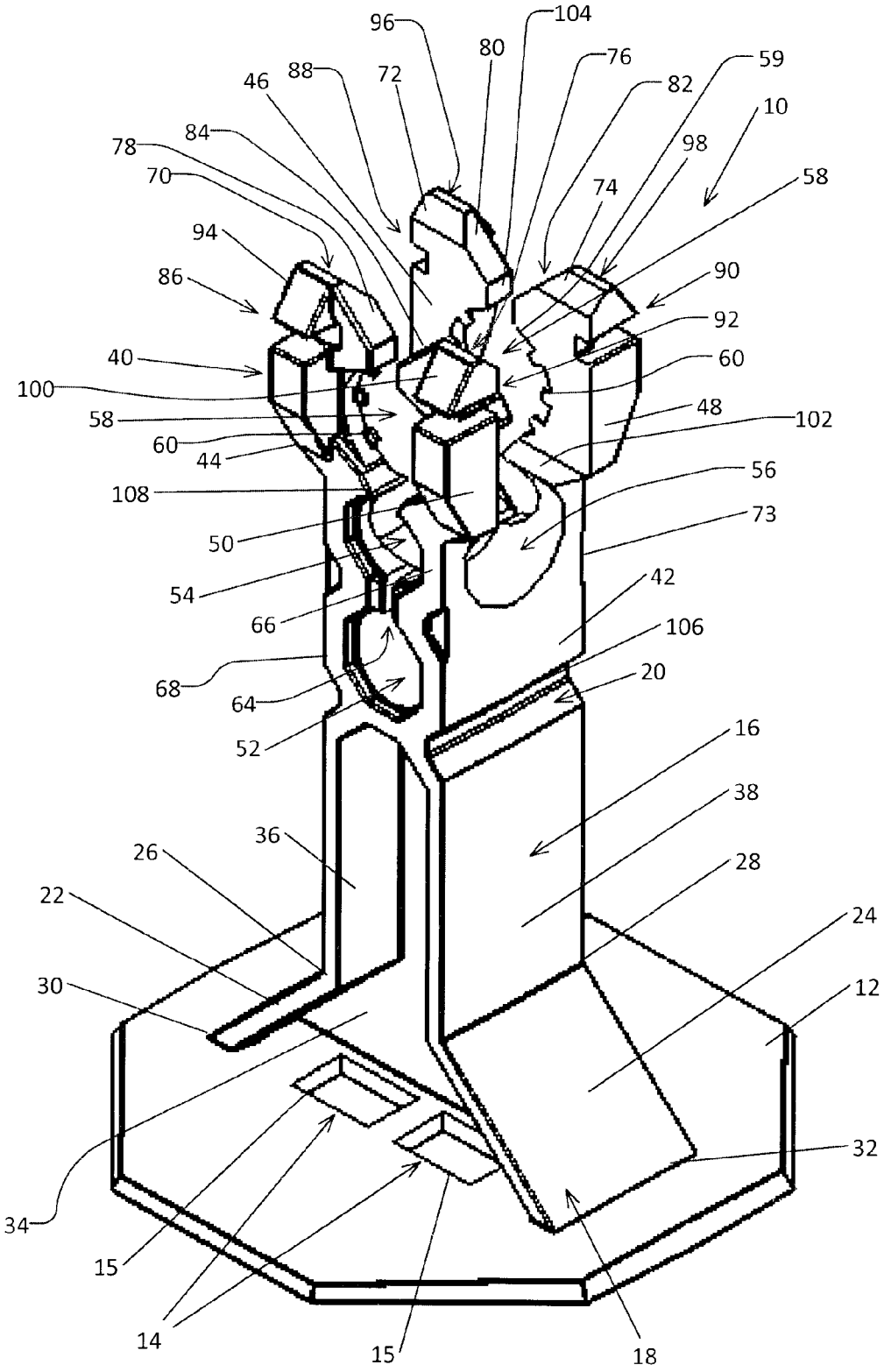
FIG. 1 is a perspective view of a multifunction concrete reinforcement support and tying device in accordance with a first embodiment of the present invention.
Figure 2:
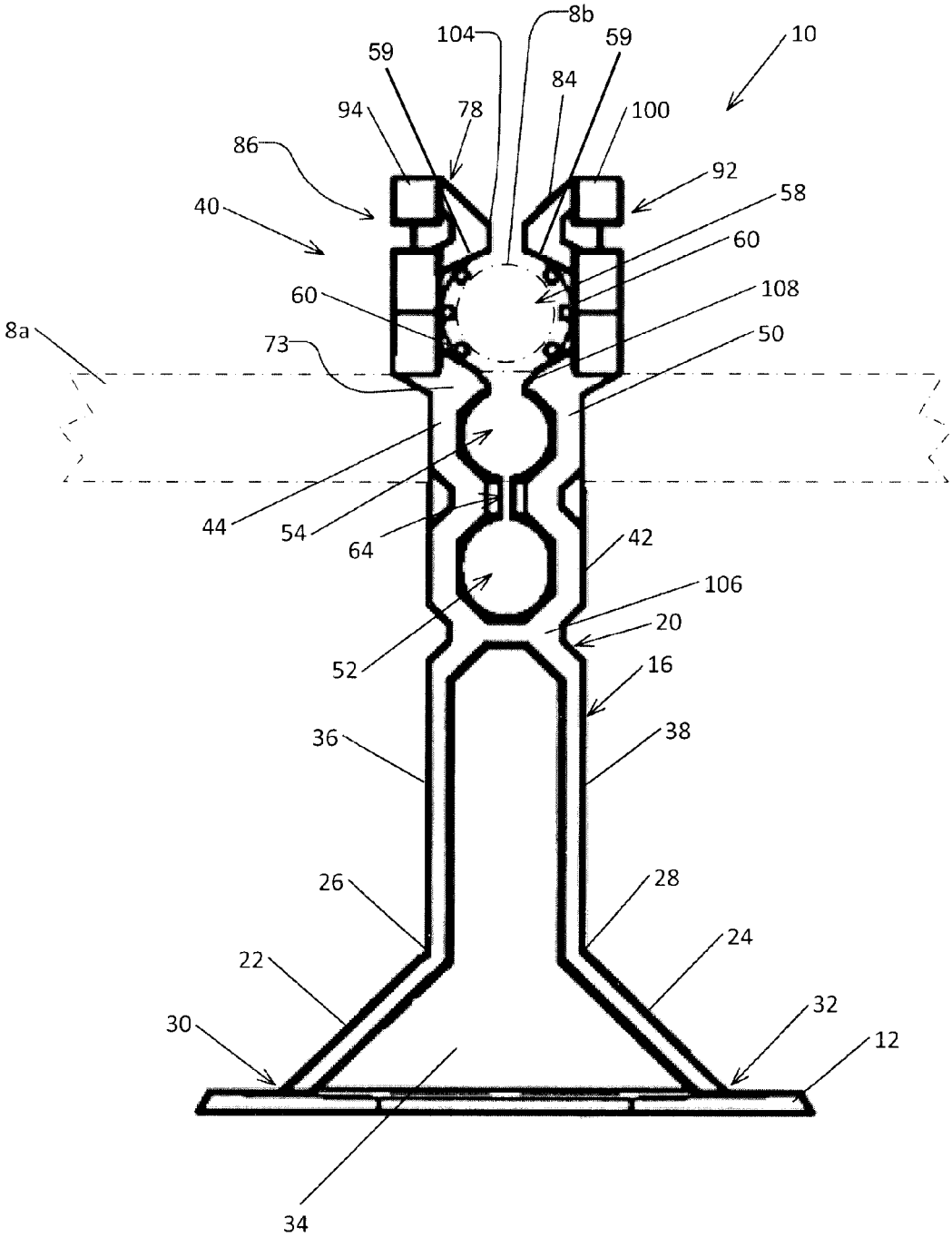
FIG. 2 is a front view of the multifunction device shown in FIG. 1.
Figure 3:
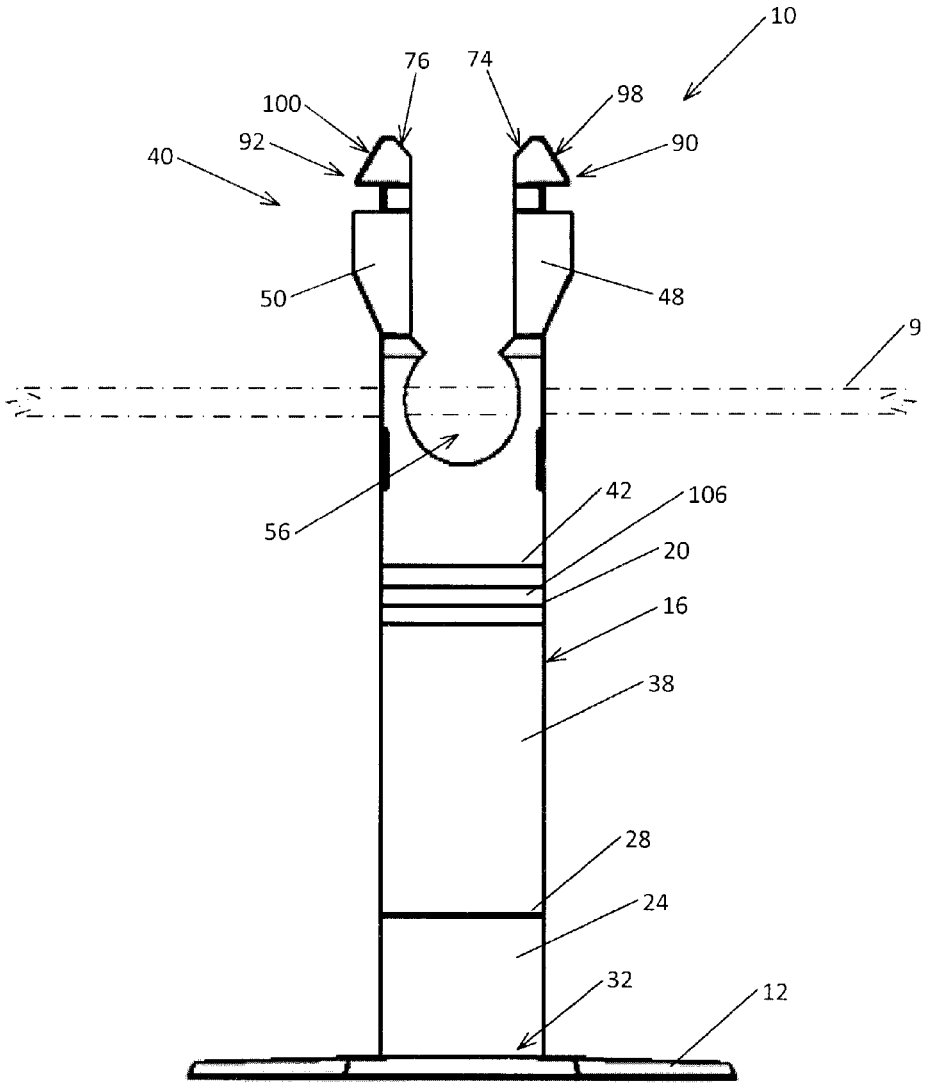
FIG. 3 is a side view of the multifunction device shown in FIG. 1.
Figure 4:
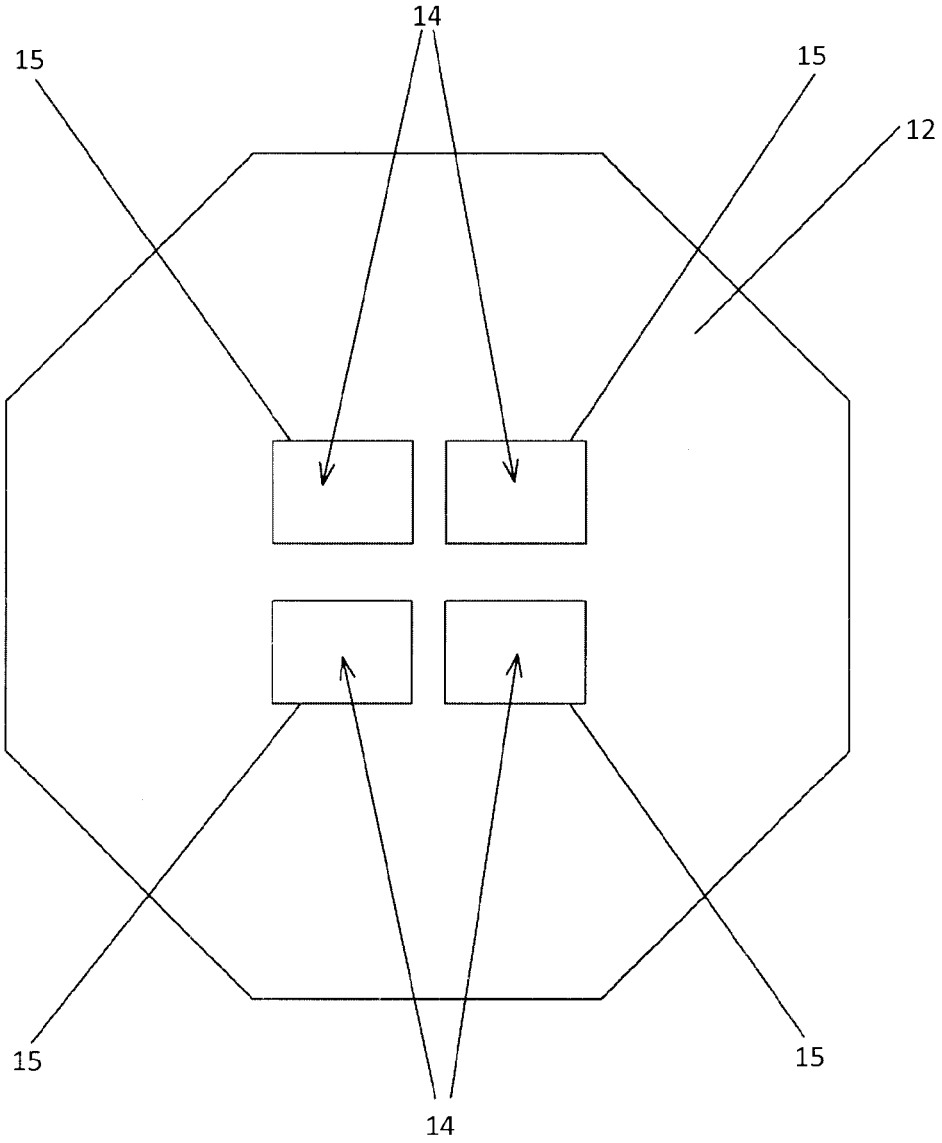
FIG. 4 is a bottom view of the multifunction device shown in FIG. 1.

Referring to FIGS. 1-5, an embodiment of a multifunction device 10 for positioning reinforcing materials within poured concrete is provided. The multifunctional device 10 preferably comprises a relatively flat octagonal base plate, or disc, 12 that is preferably about $1/8^{th}$ of an inch thick and defines therein a plurality of rectangular apertures 14, preferably four apertures, adapted for allowing interconnection of the base of one multifunction device end-to-end with another multifunctional device.

Extending from the base 12 is an I-beam construction central post 16, having a first, or lower, end 18 and a second, or upper, end 20 that has diagonally extending struts 22, 24 that extend from an intermediate lower portion 26, 28, respectively, of the post, about $2/3^{rd}$ of the way down the post from the upper end 20, to interconnect the post with a wider intersection area at 30, 32 between the post and the base.

Looking from a top view down scanning at successively lower cross-section views of the I-beam post 16, extending from the top, or second end 20, of the post, to the bottom, or first end 18 of the post, it will be appreciated that a cross section "I" would be visible with the central portion of the "I" represented by wall 34, one end of the "I" being represented by beam 36, and the other end of the "I" being represented by beam 38. As the cross-section scan proceeds downwardly from second end 20 of post 16, the "I" would remain the same height, but proceeding with the scan towards the base 12 past point 26, 28, the cross-section representation of the wall 34 would start to be longer until it reaches the tallest "I" cross section at the point where the post 16 intersects with the base 12 at intersection 30, 32. Though the areas of intersection 30, 32 between the post 16 and base 12 are preferably parallel to one of the flat sides of the octagonal base and the central wall 34 is preferably parallel to a flat side of the octagonal base that is normal to the previously described side of the base, this is not essential to the device as claimed. As suggested by the concept of I-beam construction, the upper and lower ends of the "I" represented by 22, 36, 24, 38, are at normal right angles to wall 34.

The I-beam construction of the post 16 of the device 10 is important for resisting compressive and torsional forces often encountered by such a device when used for interconnecting reinforcement materials for poured concrete.

Preferably integrally extending from the second end 20 of the post 16, the multifunction device further comprises a multifunction clip 40. Multifunction clip 40 comprises a saddle portion 42 from which there are extended vertically four uprights 44, 46, 48, 50. Each of the four uprights 44, 46, 48, 50 is preferably integral with the saddle portion 42, the saddle portion at the interconnection area with the uprights defining a hole 52, this hole comprising means for biasing the multifunction clip 40, for allowing the uprights to be adapted for being forced or expanded outwardly from a pre-installation first position shown to a second position (not shown).

Uprights 44, 46, 48, 50 also define a plurality of sockets adapted for receipt and gripping of concrete reinforcing materials, such as rebar or wire mesh. At an intermediate level of the multifunction clip 40, a smaller lower most socket 54 is designed for receipt of a smaller sized reinforcing material corresponding to a smaller diameter reinforcing stock such as wire mesh. The socket 54 is designed to be approximately the same size as the reinforcing material such that upon pushing of the reinforcing material into the socket, the socket will grip onto, or essentially snap into place around, the reinforcing material. The device 10 need not necessarily be able to grip the mesh in more than one direction, as is necessary in the case of tying rebar, since the wire mesh has already been welded at intersections of the wire mesh and thus the elements of the wire mesh need not be interconnected by the multifunction clip.

Uprights 44, 46, 48, 50 define another intermediate level socket 56 normal to socket 54, socket 56 being adapted for receiving and gripping a larger piece of concrete reinforcing stock such as rebar that is larger in diameter than the wire mesh, the uprights being allowed to bias or deform enough to allow insertion of the larger stock after which the uprights return to their pre-installation position with the uprights and socket gripping the larger stock in the socket 56. It is apparent that the device 10 is adapted for retaining either the larger stock in socket 56, or the smaller stock in socket 54, at any given time, since the holes of the two different diameter sockets intersect within the device.

Uprights 44, 46, 48, 50 define another highest level socket 58 normal to and above socket 56, socket 58 being adapted for receiving and gripping a larger piece of concrete reinforcing stock than that of socket 54, but preferably of the same diameter as the reinforcing material for which socket 56 is adapted. Socket 58 further comprises a plurality of nubs 60 protruding into the socket for gripping the reinforcing material.

During installation of reinforcing material into the supporting device 10, the uprights 44, 46, 48, 50 are able to be spread sufficiently apart from a first pre-installation position during receipt of a reinforcing element, the uprights being spread to their outermost extent at a second position when a piece of reinforcing material, such as rebar or wire mesh, is pushed to the widest diameter position of the rebar or wire mesh on the multifunction clip 40 with enough force sufficient to push the reinforcing material past the widest portion of the material and into the multifunction clip. Thus the hole 52 defined adjacent the saddle portion 42 sufficiently weakens the uprights 44, 46, 48, 50 at their point of attachment to the saddle to allow biasing and temporary deformation of the uprights outwardly to allow receipt of the reinforcing material into the wire mesh socket 54 or the uppermost rebar socket 58, since these two sockets are oriented parallel to hole 52 and a gap 64 above hole 52 to allow further spreading of uprights 44, 46 apart from uprights 48, 50. This means for biasing and allowing biasing of uprights 44, 46 apart from uprights 48, 50 as reinforcing material is pressed into the socket 54 or socket 58 is further aided by a narrowed neck 106 interconnection between the second end 20 of post 16 and saddle portion 42. The narrowed neck 106 weakens the interconnection points of the uprights 44, 46, 48, 50 to allow them to be temporarily deformed outwardly from a first pre-installation position to as second deformed position to allow passage of the largest cross section diameter portion of the reinforcing material through clip retention portion 104, 108, after which the uprights naturally resume their first pre-installation position to clamp, grip and retain the reinforcing material within the socket.

This process occurs whether rebar 8*b* is being retained in socket 58 or whether mesh 9 is being retained in socket 54. Thus, in the case of rebar 8*b*, it is retained by the upper portions 59 of socket 58 where and as they intersect with edge clip retention portions 104, and in the case of mesh 9, it is retained by the upper portions of socket 54 where and as they intersect with edge clip retention portions 108. Similarly, in the case of rebar 8*a*, it is retained by the upper portions of socket 56 where and as they intersect with edge clip retention portions 102.

Thus, in use, the reinforcing material support device 10 is capable in essence of clipping, or tying, two pieces of rebar 8*a*, 8*b*, in stacked but normal relation to each other, or the device 10 is capable of clipping onto and supporting wire mesh 9. While it would be a less common occurrence, it will be appreciated that conceivably the device could also be used to both clip and support wire mesh 9, while at the same time clipping and supporting rebar 8*b*. Further, while in the present embodiment a user would be prevented from supporting both rebar pieces 8*a* and 8*b* as well as simultaneously supporting wire mesh 9, since the mesh and rebar 8*a* would have to occupy the same space, it will be appreciated that longer uprights defining an additional layer of sockets could be devised without departing from the scope of the invention as claimed.

For receiving stock into socket 56, the opening at the top of socket 56 and sidewall portions 70 (not shown in FIG. 1), 73 are made of thin enough plastic that they are able to be forced apart from an initial, pre-installation first position by pressing stock into the socket 56 to allow temporary deformation of the uprights 44, 50 apart from uprights 46, 48 to a second position at the widest spread apart distance of the uprights to allow passage of the rebar stock into the lower socket 56. After the rebar stock is pressed into the lower socket 56 past the midpoint largest diameter of the rebar stock, the uprights begin to return back to their pre-installation first position until the stock is completely seated and engaged by lower socket 56 where the uprights have completely returned back to their pre-installation first position.

The uprights 44, 46, 48, 50 of the multifunction clip 40 are adapted for then returning to the pre-installation first position around the reinforcing element as the reinforcing element moves into fully engaged positioned within the socket formed by the uprights.

A plurality of inner angled surfaces 70, 72, 74, 76 facilitate installation of the multifunction support device 10 on a first piece of rebar into lower rebar socket 56, the angled surfaces guiding the rebar 8*a* into place and serving to press uprights 44, 50 away from uprights 46, 48 as the rebar is pushed into the socket, or vice versa as the device 10 is pushed onto the rebar, until a midway point on the cross section of the rebar reaches edge clip portions 102 of socket 56, at which point the uprights 44, 50 start to move back towards uprights 46, 48 to grip securely around the rebar as the rebar moves towards becoming fully positioned within the socket.

A plurality of inner angled surfaces 78, 80, 82, 84 facilitate installation of the multifunction support device 10 on a second piece of rebar 8*b* into upper rebar socket 58, the angled surfaces guiding the rebar 8*b* into place and serving to press uprights 44, 46 away from uprights 48, 50 as the rebar is pushed into the socket, until a midway point on the cross section of the rebar reaches edge clip portions 104 of socket 58, at which point the uprights 44, 46 start to move back towards uprights 48, 50 such that nubs 60 grip securely around the rebar as the rebar moves towards becoming fully positioned within the socket.

Alternatively, the plurality of inner angled surfaces 78, 80, 82, 84 also facilitate installation of the multifunction support device 10 on a piece of wire mesh 9 into lower socket 54 in the case where the multifunction support device is used to support and grip onto wire mesh instead of the larger diameter rebar. Thus, it will be apparent to those of ordinary skill in the art that the present invention is adapted for positioning, gripping and supporting at a pre-determined distance above a supporting surface one of two different diameter concrete reinforcing elements. In the case of rebar 8*a*, 8*b*, the device 10 is adapted for receiving, gripping, tying and supporting a pair of horizontally extending pieces of rebar intersecting at right angles but extending in adjacent planes and at a pre-determined distance above a supporting surface. In the case of wire mesh 9, the device 10 is adapted for receiving, gripping and supporting the wire mesh at a predetermined distance above the supporting surface.

Figure 5:
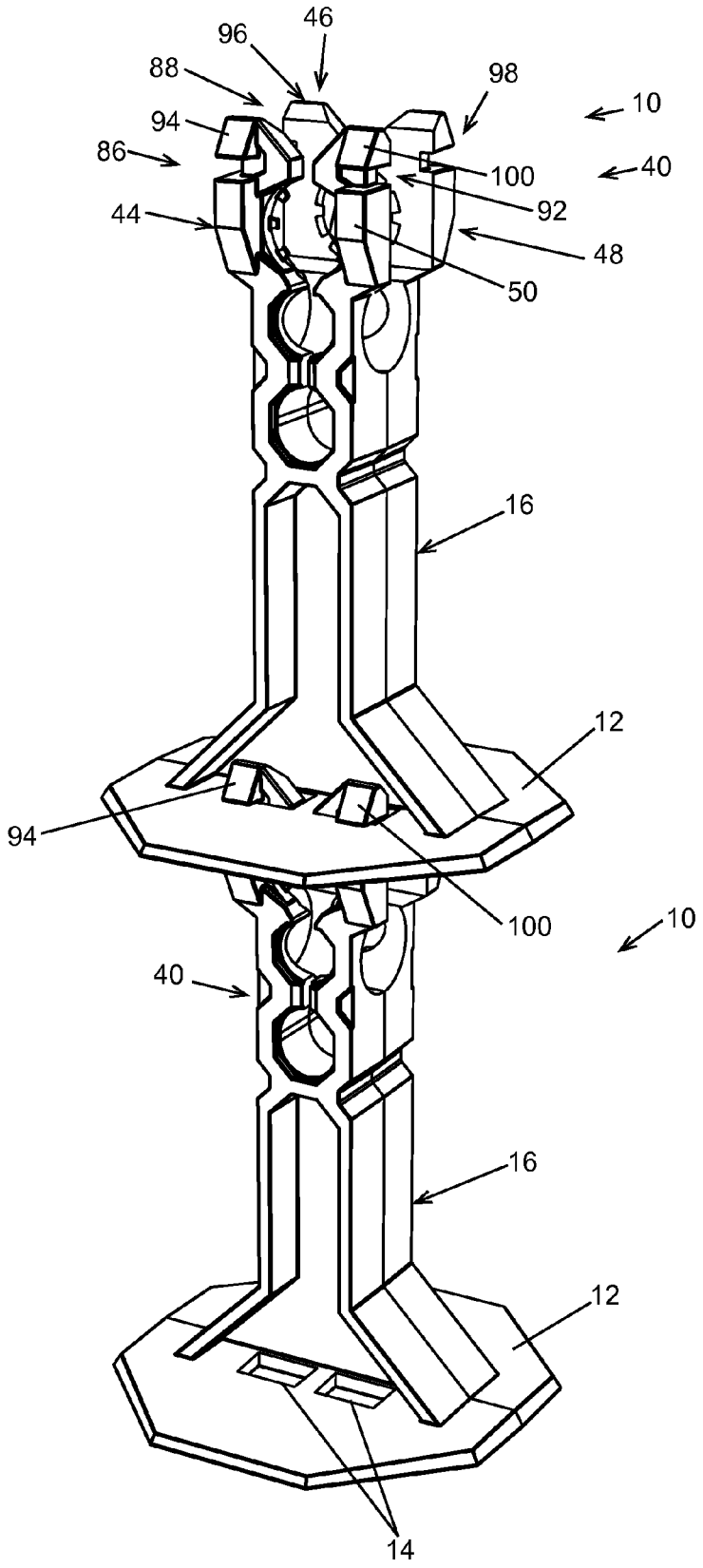
FIG. 5 is a perspective view of two identical multifunction devices of FIG. 1 and shown interconnected and stacked so as to be adapted for use with a thicker concrete pour.

Referring specifically to FIG. 5, uprights 44, 46, 48, 50 further comprise prongs 86, 88, 90, 92 which are adapted for being received into receptacles 14 of a base 12 of another identical multifunction device 10 to allow interconnected stacking of two or more multifunction devices to allow creation of a layered reinforcement structure for thicker concrete pours. A plurality of outer angled surfaces 94, 96, 98, 100 on prongs 86, 88, 90, 92, respectively, facilitate installation of the multifunction support device 10 into the receptacles 14. In practice, an upper device 10 would be attached to a lower device 10 after rebar 8*a*, 8*b*, or wire mesh 9, has been installed in the lower device. Thereafter the rebar, or wire mesh, would be installed into the upper device 10.

During attachment of one multifunction device 10 to another multifunction device 10, the outer angled surfaces 94, 96, 98, 100 are engaged with outer edges 15 of receptacles 14 as the base 12 of the upper device 10 is pressed onto the lower device 10. The pressure applied in this action forces the uprights 44, 50 to be biased inwardly towards the uprights 46, 48 as the angled surfaces 94, 100 and 96, 98 slide along outer edges 15 of the other device 10. This inward bias continues towards an inward ultimate extent of deformation until the angles surfaces 94, 100, 96, 98 reach their ultimate extent and path of travel along edges 15, at which point the uprights snap back into their pre-installation position with overhang and opposing base surfaces of prongs 86, 88, 90, 92 engaging the upper and lower surfaces, respectively, of the other base 12 with the base member partially residing in the opening defined by each prong all to prevent pulling apart or further insertion of the now interconnected devices 10. This process may be repeated for successive layers of reinforcing materials to be accommodated to reinforce thicker concrete pours. While this aspect of the invention calls to attention the importance for enhanced stability and enhanced strength provided by the I-beam construction and other features of the present invention which better resist torsional and compressive forces over prior art devices, it will be appreciated that nevertheless the invention is preferably constructed of polyoxymethylene (POM) plastic, or alternatively of acrylonitrile butadiene styrene (ABS) regrind plastic. While the POM plastic is preferred, it will be appreciated that other materials may be devised for manufacture of the device 10 which may even be stronger for special applications, and such would fall within the spirit and scope of the invention as claimed.

Figure 6:
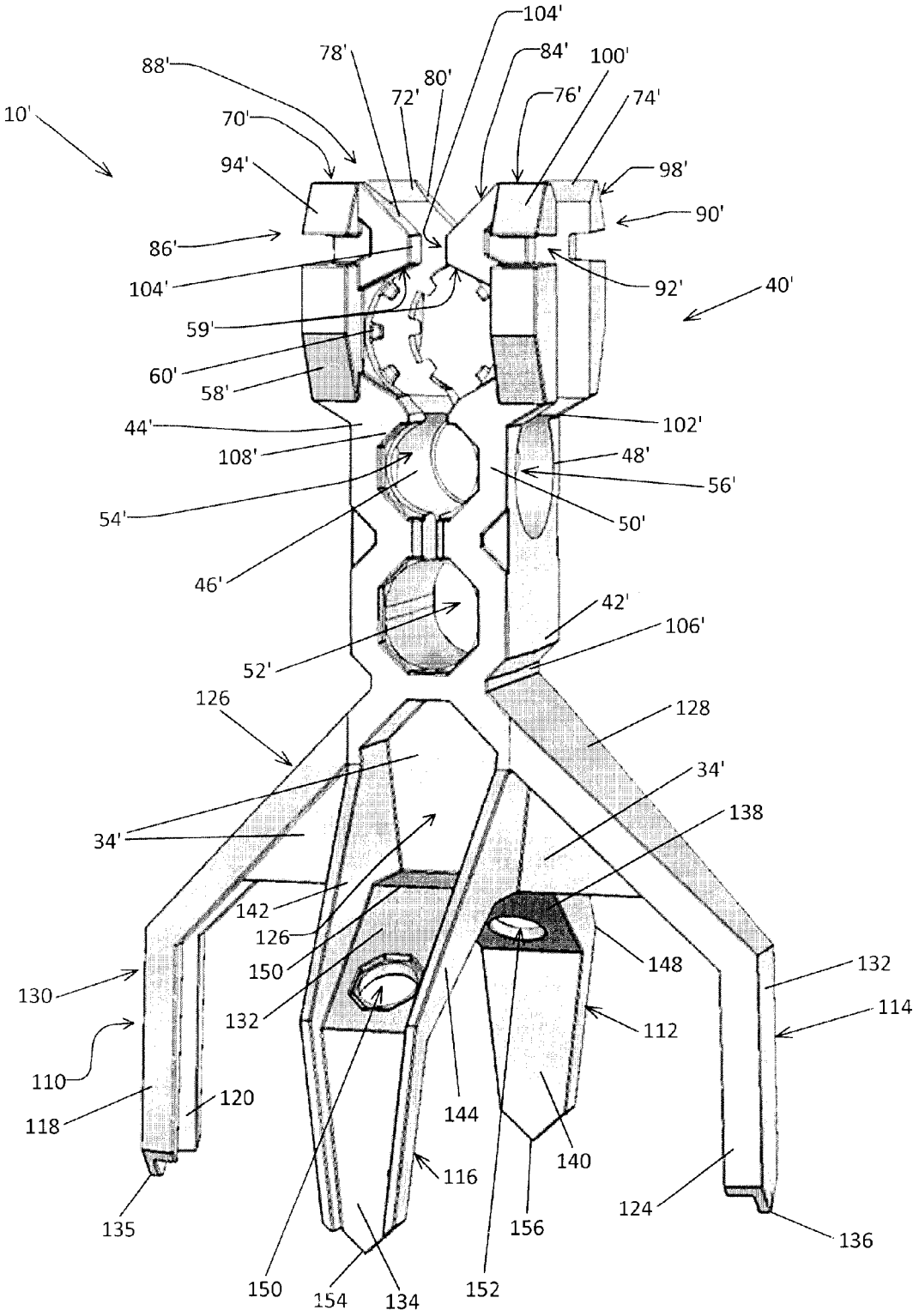
FIG. 6 is a perspective view of a multifunction concrete reinforcement support and tying device primarily for tilt-up wall construction and in accordance with an alternate embodiment of the present invention.
Figure 7:
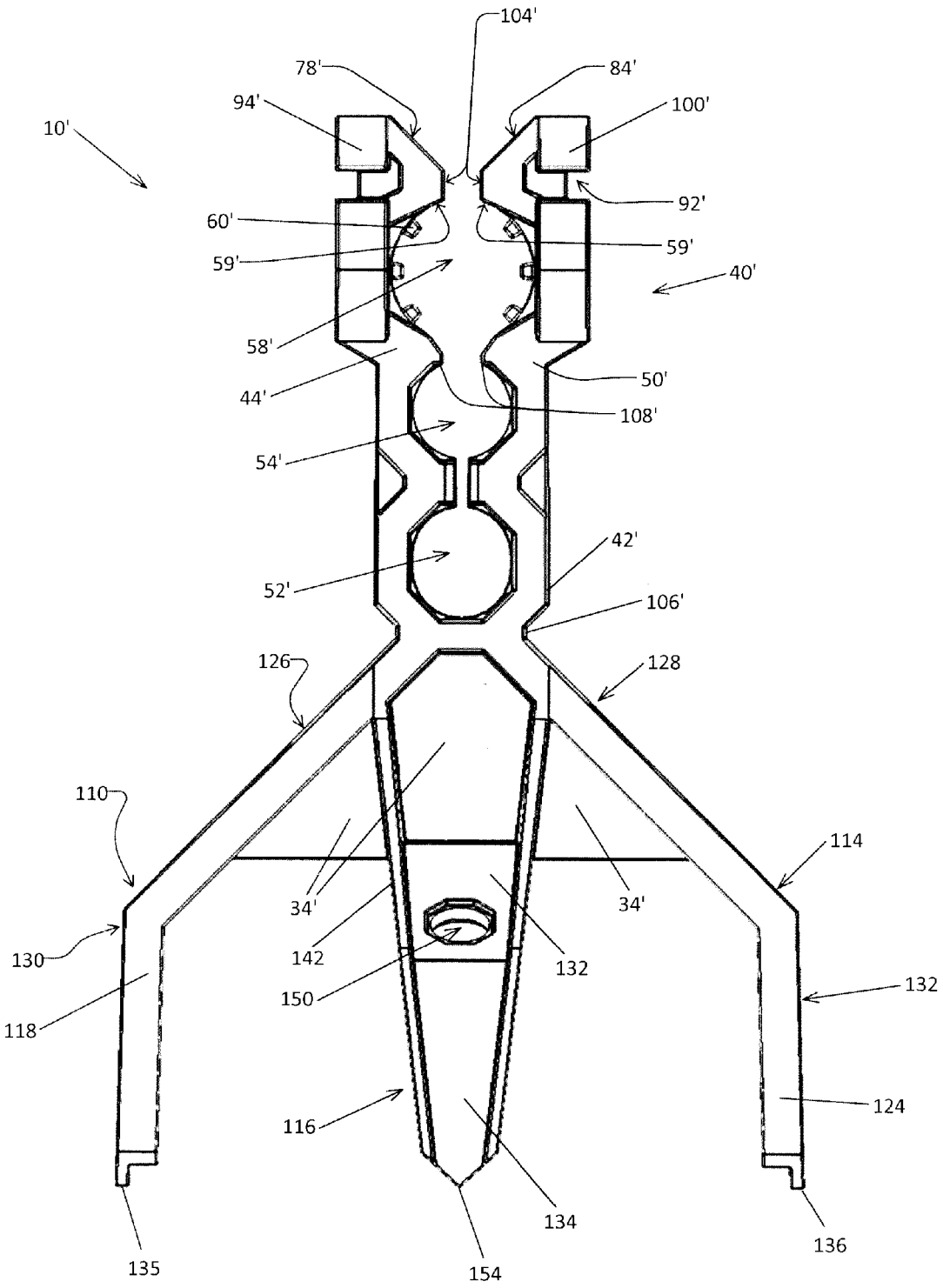
FIG. 7 is a front view of the multifunction device of FIG. 6.

Referring now to FIGS. 6 and 7, an alternate embodiment of a reinforcing materials support device 10' is shown comprising a multifunction clip 40' that is the same as multifunction clip 40 shown in FIG. 1. Thus, it will be apparent to those of ordinary skill in the art that multifunction clip 40' likewise comprises uprights 44', 46', 48' and 50', the uprights defining hole 52' and sockets 54' (with edge clip portion 108'), 56' and 58' (with nubs 60'), all of which perform the same, or similar, functions to those described above. Also, like the angled surfaces 70, 72, 74, 76 and edge clip portion 102 of the multifunction clip 40 of the support device 10, the multifunction clip 40' of the support device 10' also comprises inner angular surfaces 70', 72', 74', 76', and edge clip retention portion 102', for assisting with installation and retention of rebar 8*a* in socket 56' similarly as described above with counterpart structures. Further, like the angled surfaces 78, 80, 82, 84, upper portion 59 and edge clip portion 104 of multifunction clip 40 of the support device 10, multifunction clip 40' of the support device 10' also comprises inner angular surfaces 78', 80', 82' 84', upper portion 59' and edge clip portion 104', for assisting with installation and retention of rebar 8*b* in socket 60', or alternatively wire mesh 9 in socket 54', similarly as described above.

Still further, similar to the outer angled surfaces 94, 96, 98, 100, and the prongs 86, 88, 90, 92 of multifunction clip 40 of device 10, the multifunction clip 40' of the support device 10' also comprises outer angular surfaces 94', 96' 98', 100' and prongs 86', 88', 90', 92' for assisting with interconnecting and retention of two devices 10' and 10 in stacked relationship as described above. Thus, the angular surfaces 94', 96', 98', 100' are pressed against outer edges 15 of receptacles 14 of a base 12 of a device 10 until uprights 44', 46', 48', 50' are forced inwardly a sufficient distance and until the overhang and opposing base surfaces of prongs 86', 88', 90', 92' engage with the upper and lower surfaces of base 12, respectively, to retain the devices in end-to-end stacked and interconnected relationship as described above. Of course this would usually be accomplished after rebar or mesh was already installed in the lowermost device 10'.

Attached adjacent a saddle portion 42' of the multifunction clip 40', is a narrowed neck portion 106', each serving the same purposes as their counterparts in device 10, to integrally connect the multifunction clip with a plurality of base legs 110, 112, 114, 116 for supporting the device 10' on a supporting surface. Similar to central wall 34 of device 10, there is a central wall 34', or in actuality three central walls 34', continuing the I-beam construction concept of device 10'. Thus, base legs 110, 114 essentially comprise the upper and lower portions of the "I" of the I-beam concept, and central wall 34' comprises the center post of the "I", however, to provide added rigidity and strength resistant to compressive forces, added ribs 118, 120, 122 (not shown), 124 further comprise the base legs 110, 114, respectively. Each base leg 110, 114 further comprises an upper surface 126, 128 for the portion of the base leg that extends diagonally downwardly and away from the narrow neck portion 106' towards the supporting surface, and an outer surface 130, 132, respectively, that extends downwardly from each upper surface. There is an angle built into each base leg 110, 112, 114, 116 such that the upper approximately ⅔rd of the base leg extends diagonally downwardly from and away from the point of integral attachment of each base leg at narrowed neck 106', and then the base leg extends more vertically toward the supporting surface for the lower ⅓rd of the base leg.

Each base leg 110, 114 is tapered from the point of integral attachment at narrowed neck 106' to where each base leg ends at a point 135, 136, respectively, to minimize the area of contact between the device 10' and the supporting surface. This is desirable for tilt-up construction concrete pours so that the base will not be seen on the exterior of the concrete slab once it is tilted up to form the wall of a building as would be the case with device 10. This, in turn relieves the visual and finishing deficiencies of some prior art support devices used for tilt-up construction purposes.

Extending from beneath the added ribs 118, 120, 122, 124, as well as from central wall 34', are base legs 116, 112. Each base leg 116, 112, comprises a channel 126, 128 (not shown), having channel bottoms 130, 132, 134 forming base leg 116, and channel bottoms 136 (not shown), 138, 140 forming base leg 112. Further, base leg 116 further comprises side walls 142, 144 and base leg 112 further comprises side walls 146 (not shown), 148. There is an aperture 150, 152 defined in each channel bottom 132, 138 respectively. Each base leg 112, 116, is tapered from the point of integral attachment at narrowed neck 106' to where each base leg ends at a point 156, 154, respectively, to minimize the area of contact between the device 10' and the supporting surface. Again, this is desirable for tilt-up construction concrete pours as described previously.

Figure 8:
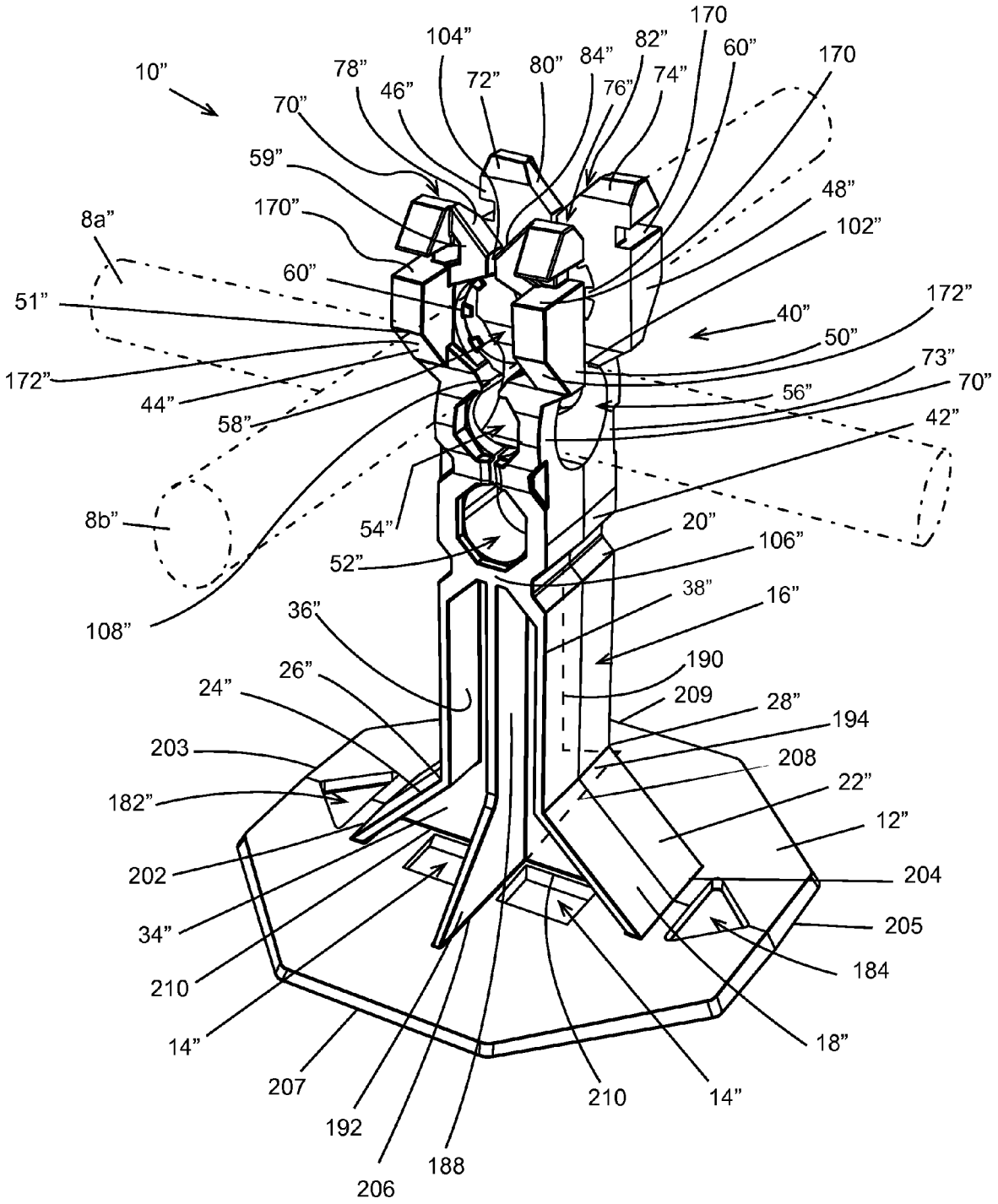
FIG. 8 is a perspective view of a preferred multifunction concrete reinforcement support and tying device in accordance with another alternate embodiment of the present invention.
Figure 9:
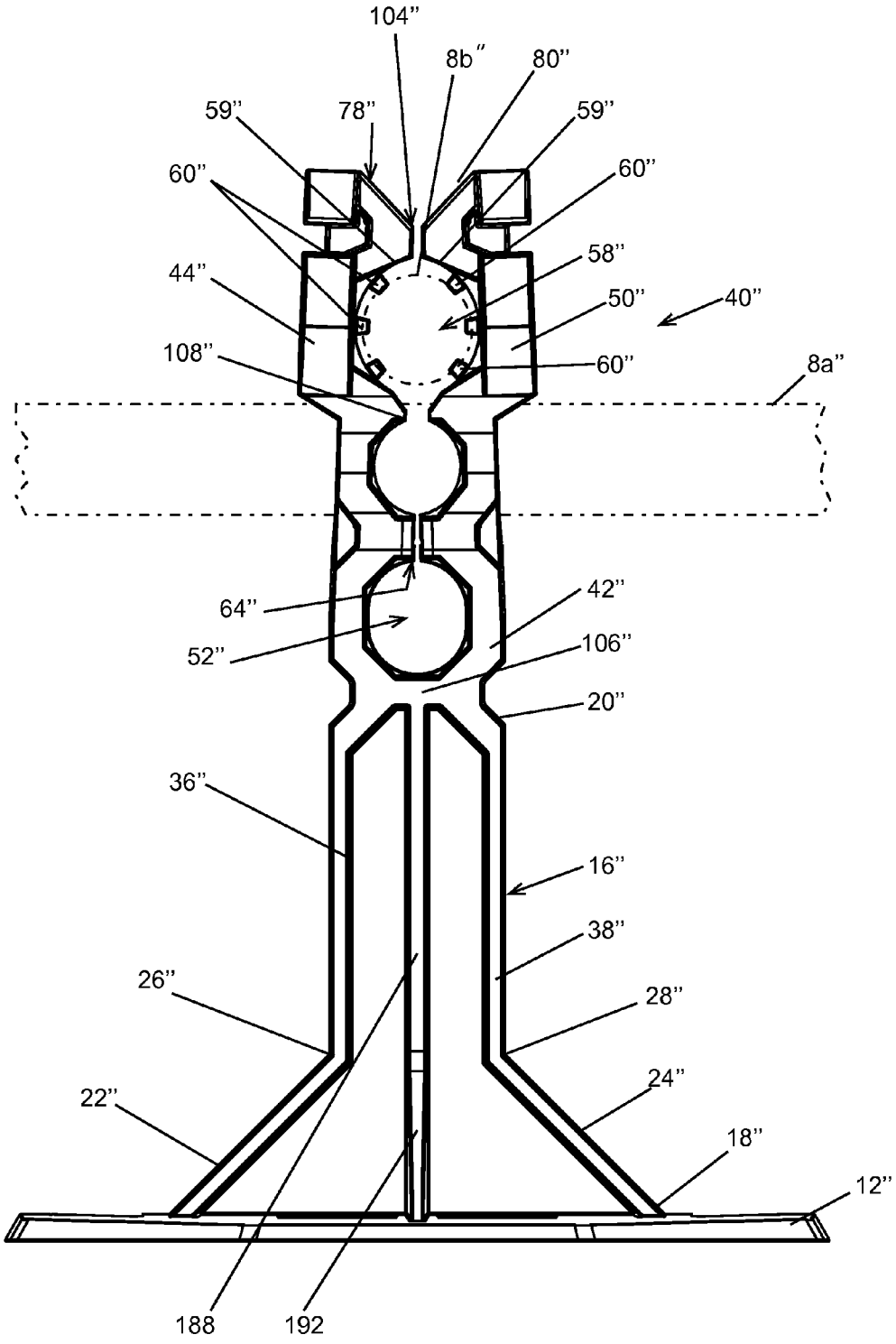
FIG. 9 is a front view of the multifunction concrete reinforcement support and tying device of FIG. 8.
Figure 10:
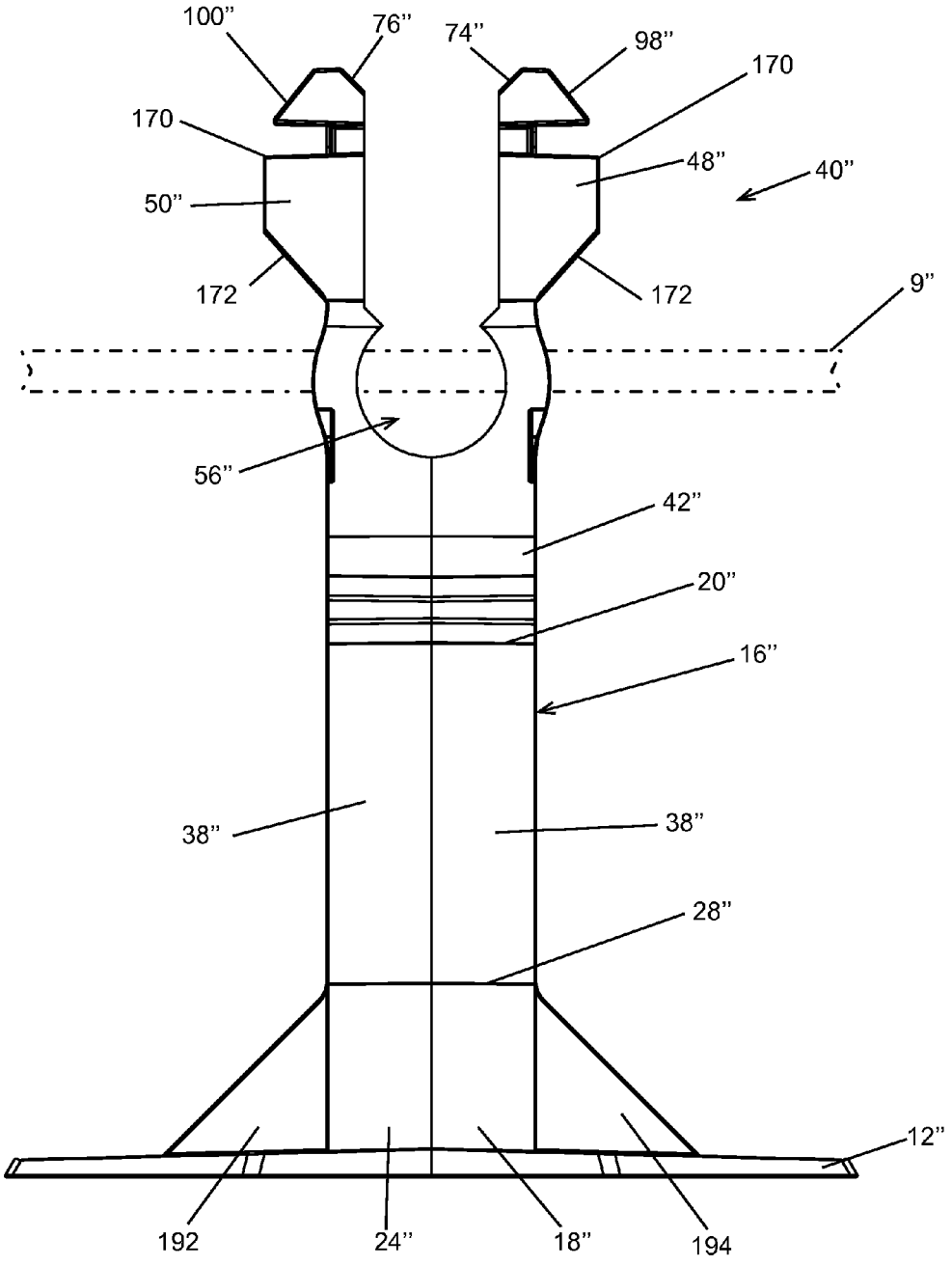
FIG. 10 is a right side view of the multifunction concrete reinforcement support and tying device of FIG. 8.
Figure 13:
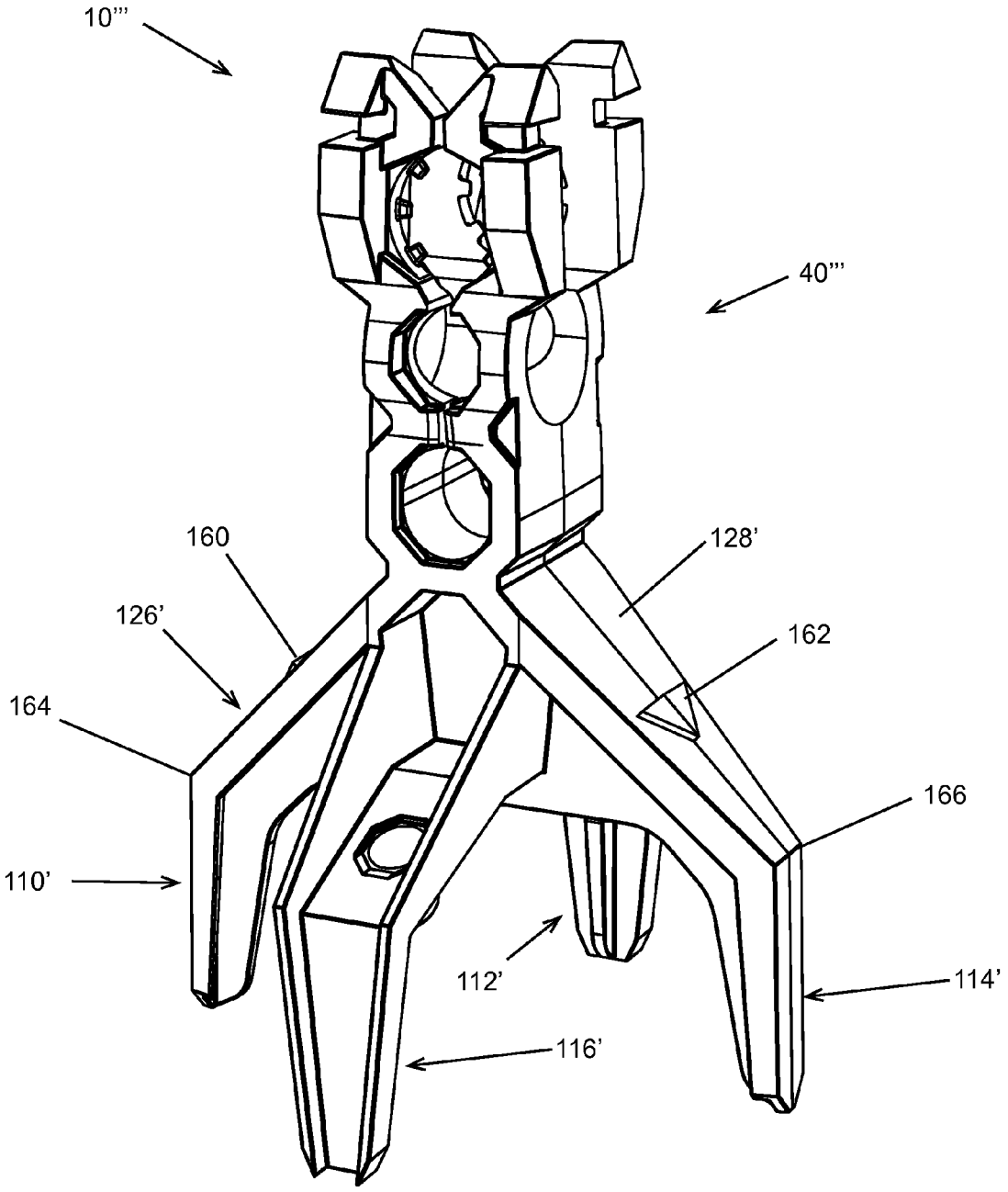
FIG. 13 is a perspective view of another alternative embodiment of a multifunction concrete reinforcement support and tying device primarily for tilt-up wall construction.
Figure 14:
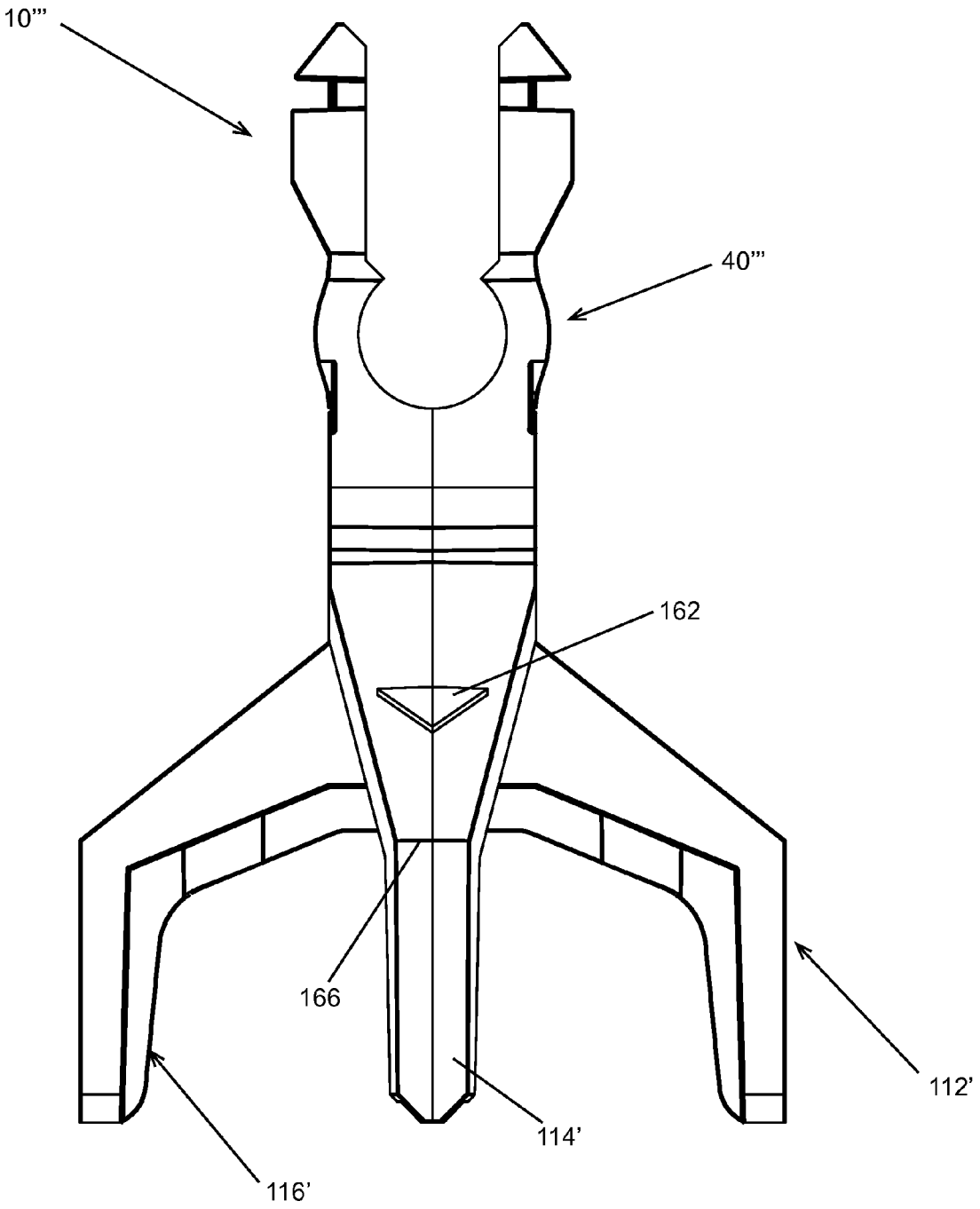
FIG. 14 is a right side view of the alternative embodiment of the multifunction concrete reinforcement support and tying device shown in FIG. 13.
Figure 15:
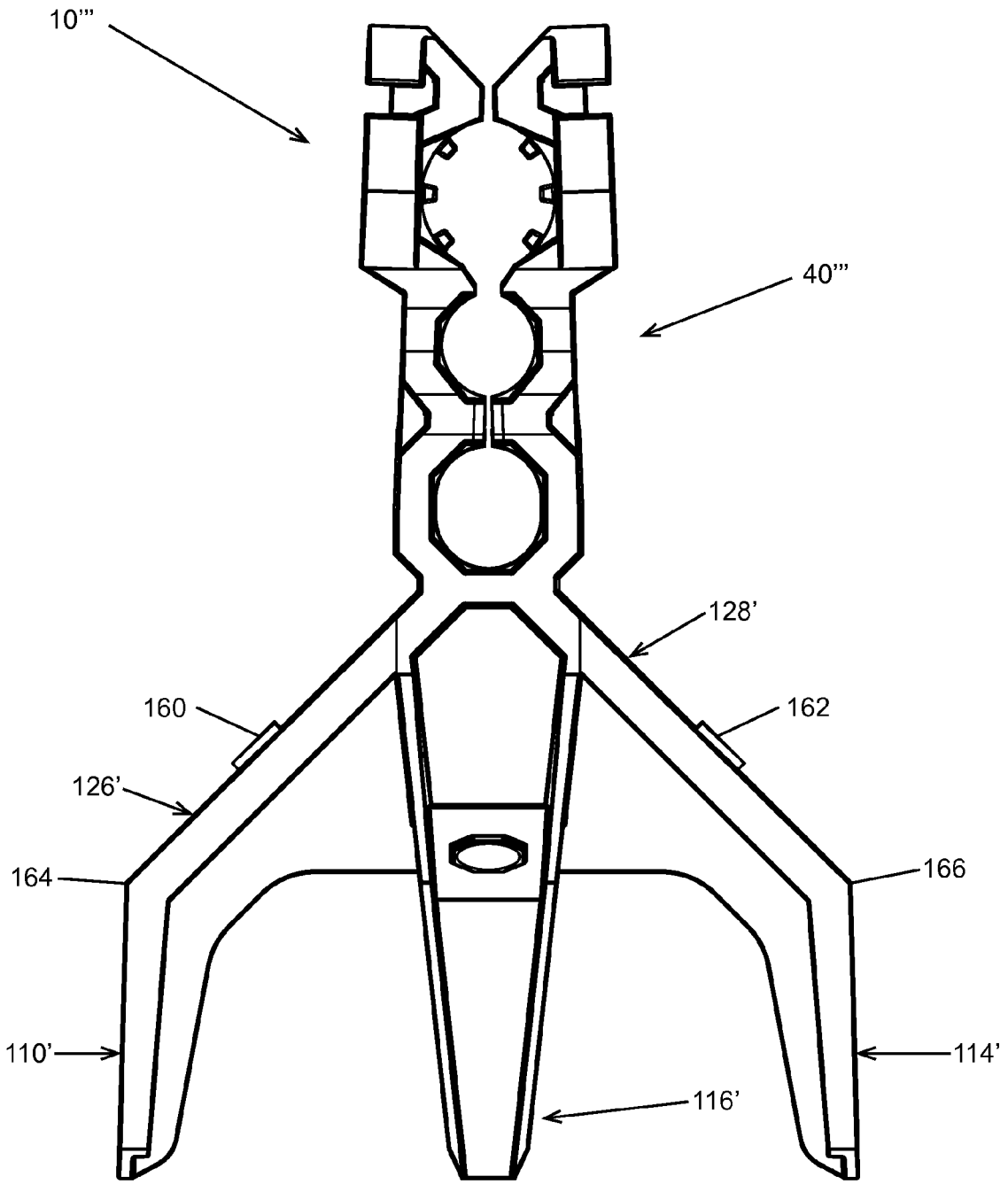
FIG. 15 is a front view of the alternative embodiment of the multifunction concrete reinforcement support and tying device shown in FIG. 13.

Referring specifically to FIGS. 13-15, there is provided an alternate embodiment of a reinforcing materials support device 10''' that is substantially the same as the reinforcing materials support device 10' in that multifunction clip 40''' is identical to multifunction clips 40 and 40', with all of their respective constituent parts or sub-elements, or alternatively may be constructed with enhanced features identical to multifunction clip 40" discussed hereafter in connection with FIG. 8 with all its constituent parts or sub-elements. Further, the base legs 112', 116' are identical to base legs 112, 116, respectively, of device 10. Still further, base legs 110', 114' are substantially identical to base legs 110, 114, respectively, with all their constituent parts, or sub-elements, except that device 10''' is provided with alignment guiding arrows 160, 162 shown embossed on upper surfaces 126', 128' of legs 110', 114', respectively. Each alignment guiding arrow 160, 162 points outwardly towards a bend 164, 166 in each of legs 110', 114', respectively, to further facilitate ease of use of the device. The plurality of alignment guide arrows 160, 162 are for guiding a user in the proper orientation of the device for placement on the ground. The arrows 160, 162 easily signify to the user the need to place the device with the arrows oriented in parallel alignment to the longitudinal axis of the lower piece of rebar to be placed and held in the device. Further, in terms of aligning two devices for easy stackability, the punched-through arrows also guide the user in aligning two devices 10''', 10 for stacking, the devices being attachable in the orientation wherein the arrows of each of the devices are aligned with each other, with one device in such position able to be stacked on top of the other. If the arrows of two multifunction devices 10''', 10 in accordance with this aspect of the invention are oriented normal to each other, the devices will not readily attach to each other. Thus, the arrows 160, 162 serve multiple purposes in facilitating use of the invention.

The clip portion 40''' of the reinforcing materials support device 10''' may be provided to be the same as the clip portion 40' described above in connection with device 10'. Alternatively, the clip portion 40''' of device 10''' may be constructed with enhanced features of clip 40" as further described in connection with reinforcing materials support device 10" shown in FIG. 8.

Referring now to FIGS. 8-12, there is provided an alternate embodiment of a multifunction device 10" for positioning reinforcing materials within poured concrete. The multifunctional device 10" preferably comprises a relatively flat octagonal base plate, or disc, 12" that is preferably about ⅛th of an inch thick and the opposing parallel edges of which are preferably enlarged relative to earlier embodiments to be about four to six inches apart. The octagonal base plate, or disc, 12" defines therein a plurality of rectangular apertures 14", preferably four apertures, adapted for allowing interconnection of the base of one multifunction device 10" end-to-end with another identical multifunctional device 10".

Extending from the base 12" is a back-to-back E-beam (in cross section) construction central post 16", having a first, or lower, end 18" and a second, or upper, end 20" that has diagonally extending struts 22", 24" that extend from an intermediate lower portion 26", 28", respectively, of the post, about ⅔rd of the way down the post from the upper end 20", to interconnect the post with a wider intersection area at 202, 204 between the post and the base.

Looking from a top view down scanning at successively lower cross-section views of the back-to-back E-beam post 16", extending from the top, or second end 20", of the post, to the bottom, or first end 18" of the post, it will be appreciated that two back-to-back cross section "E's" would be visible with the back-to-back central portions of the "E's" represented by integral wall 34", one end of the "E's" being represented by beam 36", and the other end of the "E's" being represented by beam 38". As the cross-section scan proceeds downwardly from second end 20" of post 16", the back-to-back "E's" would remain the same height, but proceeding with the scan towards the base 12" past points 26", 28", the cross-section representation of the wall 34" would start to be longer until it reaches the tallest back-to-back "E's" cross section at the point where the post 16" intersects with the base 12" at intersections 202, 204. Though the areas of intersection 202, 204' between the post 16" and base 12" are preferably parallel to one of the flat sides of the octagonal base and the central wall 34" is preferably parallel to a flat side of the octagonal base that is normal to the previously described side of the base, this is not essential to the device as claimed. As suggested by the concept of back-to-back E-shaped-beam construction, the upper and lower ends of the "E's" (in cross section) represented by 22", 36", 24", 38", are at normal right angles to wall 34".

There is provided on post 16" an upper, smaller width, central stabilizing beam, or rib, 188, 190 and a lower central stabilizing beam, or rib, 192, 194. The lower portion of lower central stabilizing rib 192, 194 extends integrally from smaller width central stabilizing rib 188, 190 and flares outwardly perpendicular to wall 34' as the lower portion of lower central stabilizing rib 192, 194 extends downwardly towards where it intersects at 206 with base 12" intermediate of receptacles 14" and perpendicular to inner wall 34". The inner wall 34"also intersects base 12" intermediate of receptacles 14". Thus, in order to form a sturdy base for post 16" the stabilizing ribs 192, 194 and the diagonally extending angled struts 22", 24" flare outwardly relative to a longitudinal axis of the device 10" to where each intersects in uniform, and thus sturdy and aesthetically pleasing, manner with the base 12". The intersections 200, 202, 204, 206, 208, 210 are uniform in that they are each preferably parallel to corresponding edges 203, 205, corresponding in parallel fashion with intersections 202, 204, 206, 208, and edges 207, 209, corresponding in parallel fashion with intersections 210. This not only imparts visually pleasing aesthetics to the device 10", but it also assists with visually aligning the device and lends stability to the device to resist compression and torsional forces to which the device is subjected during use. It will be appreciated, however, that other alignments of such intersections between the post and this other base configurations, such as perhaps a hexagonal, square or other base configuration, may be employed without departing from the true scope and spirit of the invention as claimed.

The back-to-back E-beam construction of the post 16" of the device 10" is important for resisting compressive and torsional forces often encountered by such a device when used for interconnecting reinforcement materials for poured concrete.

Preferably integrally extending from the second end 20" of the post 16", the multifunction device further comprises a multifunction clip 40". Multifunction clip 40" comprises a saddle portion 42" from which there are extended vertically four uprights 44", 46", 48", 50". Each of the four uprights 44", 46", 48", 50" is preferably integral with the saddle portion 42", the saddle portion at the interconnection area with the uprights defining a hole 52", this hole comprising means for biasing the multifunction clip 40", for allowing the uprights to be adapted for being forced or expanded outwardly from a pre-installation first position shown to a second position (not shown).

Uprights 44", 46", 48", 50" also define a plurality of sockets adapted for receipt and gripping of concrete reinforcing materials, such as rebar 8*a*", 8*b*" or wire mesh 9". At an intermediate level of the multifunction clip 40", a smaller lower most socket 54" is designed for receipt of a smaller sized reinforcing material corresponding to a smaller diameter reinforcing stock such as wire mesh. The socket 54" is designed to be approximately the same size as the reinforcing material such that upon pushing of the reinforcing material into the socket, the socket will grip onto, or essentially snap into place around, the reinforcing material. The device 10" need not necessarily be able to grip the mesh in more than one direction, as is necessary in the case of tying rebar, since the wire mesh has already been welded at intersections of the wire mesh and thus the elements of the wire mesh need not be interconnected by the multifunction clip.

Uprights 44", 46", 48", 50" define another intermediate level socket 56" normal to socket 54", socket 56" being adapted for receiving and gripping a larger piece of concrete reinforcing stock such as rebar that is larger in diameter than the wire mesh, the uprights being allowed to bias or deform enough to allow insertion of the larger stock after which the uprights return to their pre-installation position with the uprights and socket gripping the larger stock in the socket 56". It is apparent that the device 10" is a multifunction device in that it is adapted for retaining either the larger stock in socket 56", or the smaller stock in socket 54", at any given time, since the holes of the two different diameter sockets intersect within the device.

Uprights 44", 46", 48", 50" define another highest level socket 58" normal to and above socket 56", socket 58" being adapted for receiving and gripping a larger piece of concrete reinforcing stock than that of socket 54", but preferably of the same diameter as the reinforcing material for which socket 56" is adapted. Socket 58" further comprises a plurality of nubs 60" protruding into the socket for gripping the reinforcing material 8*b*".

During installation of reinforcing material 8*a*" into the supporting device 10", the uprights 44", 46", 48", 50" are able to be spread sufficiently apart from a first pre-installation position during receipt of a reinforcing element, the uprights being spread to their outermost extent at a second position when a piece of reinforcing material, such as rebar or wire mesh, is pushed to the widest diameter position of the rebar or wire mesh on the multifunction clip 40 with enough force sufficient to push the reinforcing material past the widest portion of the material and into the multifunction clip 40". Thus the hole 52" defined adjacent the saddle portion 42" sufficiently weakens the uprights 44", 46", 48", 50" at their point of attachment to the saddle to allow biasing and temporary deformation of the uprights outwardly to allow receipt of the reinforcing material into the wire mesh socket 54" or the uppermost rebar socket 58", since these two sockets are oriented parallel to hole 52" and a gap 64" above hole 52" to allow further spreading of uprights 44", 46" apart from uprights 48", 50". This means for biasing and allowing biasing of uprights 44", 46" apart from uprights 48", 50" as reinforcing material is pressed into the socket 54" or socket 58" is further aided by a narrowed neck 106" interconnection between the second end 20" of post 16" and saddle portion 42". The narrowed neck 106" weakens the interconnection points of the uprights 44", 46", 48", 50" to allow them to be temporarily deformed outwardly from a first pre-installation position to a second deformed position to allow passage of the largest cross section diameter portion of the reinforcing material through clip retention portion 104", 108", after which the uprights naturally resume their first pre-installation position to clamp, grip and retain the reinforcing material within the socket.

This process occurs whether rebar 8*b*" is being retained in socket 58" or whether mesh 9" is being retained in socket 54". Thus, in the case of rebar 8*b*", it is retained by the upper portions 59" of socket 58" where and as they intersect with edge clip retention portions 104", and in the case of mesh 9", it is retained by the upper portions of socket 54" where and as they intersect with edge clip retention portions 108". Similarly, in the case of rebar 8*a*", it is retained by the upper portions of socket 56" where and as they intersect with edge clip retention portions 102".

Thus, in use, the reinforcing material support device 10" is capable in essence of clipping, or tying, two pieces of rebar 8*a*", 8*b*", in stacked but normal relation to each other, or the device 10" is capable of clipping onto and supporting wire mesh 9". While it would be a less common occurrence, it will be appreciated that conceivably the device could also be used to both clip and support wire mesh 9", while at the same time clipping and supporting rebar 8*b*". Further, while in the present embodiment a user would be prevented from supporting both rebar pieces 8*a*" and 8*b*" as well as simultaneously supporting wire mesh 9", since the mesh and rebar 8*a*" would have to occupy the same space, it will be appreciated that longer uprights defining an additional layer of sockets could be devised without departing from the scope of the invention as claimed.

For receiving stock into socket 56", the opening at the top of socket 56" and sidewall portions 70", 73" are made of thin enough plastic that they are able to be forced apart from an initial, pre-installation first position by pressing stock into the socket 56" to allow temporary deformation of the uprights 44", 50" apart from uprights 46", 48" to a second position at the widest spread apart distance of the uprights to allow passage of the rebar stock into the lower socket 56". After the rebar stock is pressed into the lower socket 56" past the midpoint largest diameter of the rebar stock, the uprights begin to return back to their pre-installation first position until the stock is completely seated and engaged by lower socket 56" where the uprights have completely returned back to their pre-installation first position.

The uprights 44", 46", 48", 50" of the multifunction clip 40" are made of thick enough plastic so as to be adapted for then returning to the pre-installation first position around the reinforcing element as the reinforcing element moves into fully engaged positioned within the socket formed by the uprights. The enhanced thickness of this preferred alternate embodiment of the invention allows for sturdy and secure retention of even larger concrete reinforcing stock, with the resulting tied structure being able to withstand the sometimes heavy loads, such as are created by the clipped reinforcing members themselves, or other loads such as persons walking on the structure before pouring, as well as movement of the structure as may be necessary from time to time.

A plurality of inner angled surfaces 70", 72", 74", 76" facilitate installation of the multifunction support device 10" on a first piece of rebar into lower rebar socket 56", the angled surfaces guiding the rebar 8*a*" into place and serving to press uprights 44", 50" away from uprights 46", 48" as the rebar is pushed into the socket, or vice versa as the device 10" is pushed onto the rebar, until a midway point on the cross section of the rebar reaches edge clip portions 102" of socket 56", at which point the uprights 44", 50" start to move back towards uprights 46", 48" to grip securely around the rebar as the rebar moves towards becoming fully positioned within the socket.

A plurality of inner angled surfaces 78", 80", 82", 84" facilitate installation of the multifunction support device 10" on a second piece of rebar 8*b*" into upper rebar socket 58", the angled surfaces guiding the rebar 8*b*" into place and serving to press uprights 44", 46" away from uprights 48", 50" as the rebar is pushed into the socket, until a midway point on the cross section of the rebar reaches edge clip portions 104" of socket 58", at which point the uprights 44", 46" start to move back towards uprights 48", 50" such that nubs 60" grip securely around the rebar as the rebar moves towards becoming fully positioned within the socket.

Alternatively, the plurality of inner angled surfaces 78", 80", 82", 84" also facilitate installation of the multifunction support device 10" on a piece of wire mesh 9" into lower socket 54" in the case where the multifunction support device is used to support and grip onto wire mesh instead of the larger diameter rebar. Thus, it will be apparent to those of ordinary skill in the art that the present invention is adapted for positioning, gripping and supporting at a pre-determined distance above a supporting surface one of two different diameter concrete reinforcing elements. In the case of rebar 8*a*", 8*b*", the device 10" is adapted for receiving, gripping, tying and supporting a pair of horizontally extending pieces of rebar intersecting at right angles but extending in adjacent planes and at a pre-determined distance above a supporting surface. In the case of wire mesh 9", the device 10" is adapted for receiving, gripping and supporting the wire mesh at a predetermined distance above the supporting surface.

Figure 12:
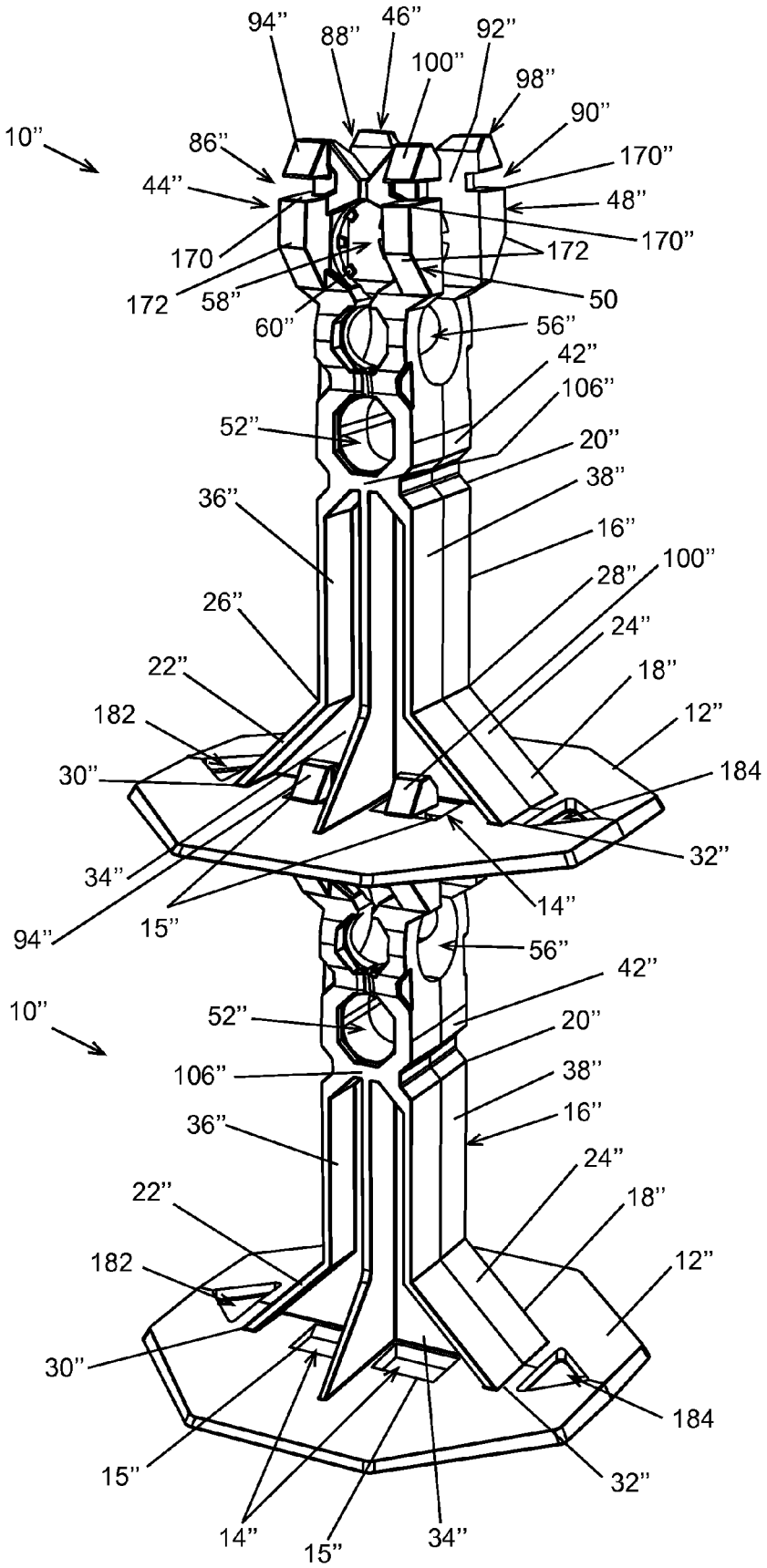
FIG. 12 is a perspective view of two identical multifunction devices of FIG. 8 and shown interconnected and stacked so as to be adapted for use with a thicker concrete pour.

Referring specifically to FIG. 12, uprights 44", 46", 48", 50" further comprise prongs 86", 88", 90", 92" which are adapted for being received into receptacles 14" of a base 12" of another identical multifunction device 10" to allow interconnected stacking of two or more multifunction devices to allow creation of a layered reinforcement structure for thicker concrete pours. A plurality of outer angled surfaces 94", 96", 98", 100" on uprights 44", 46", 48", 50", respectively, facilitate installation of the multifunction support device 10" into the receptacles 14". In practice, an upper device 10" would be attached to a lower device 10" after rebar 8*a*", 8*b*", or wire mesh 9", has been installed in the lower device. Thereafter the rebar, or wire mesh, would be installed into the upper device 10".

During attachment of one multifunction device 10" to another multifunction device 10", the outer angled surfaces 94", 96", 98", 10" are engaged with outer edges 15" of receptacles 14" as the base 12" of the upper device 10" is pressed onto the lower device 10". The pressure applied in this action forces the uprights 44", 50" to be biased inwardly towards the uprights 46", 48" as the angled surfaces 94", 100" and 96", 98" slide along outer edges 15" of the other device 10". This inward bias continues towards an inward ultimate extent of deformation until the angles surfaces 94", 100", 96", 98" reach their ultimate extent and path of travel along edges 15", at which point the uprights snap back into their pre-installation position with overhang and opposing base surfaces of prongs 86", 88", 90", 92" engaging the upper and lower surfaces, respectively, of the other base 12" with the base member partially residing in the opening defined by each prong all to prevent pulling apart or further insertion of the now interconnected devices 10". This process may be repeated for successive layers of reinforcing materials to be accommodated to reinforce thicker concrete pours. This aspect of the invention calls to attention the importance for enhanced stability and enhanced strength provided by the back-to-back E-beam construction and other features of the present invention which better resist torsional, compressive and tensile forces over prior art devices. The invention is thus preferably made of polyoxymethylene (POM) plastic, but may be made of other materials having good strength and stability under torsional, compressive and tensile forces, such as acrylonitrile butadiene styrene (ABS) regrind plastic. Thus, while the POM plastic is preferred, it will be appreciated that other materials may be devised for manufacture of the device 10" which may even be stronger for special applications, and such would fall within the spirit and scope of the invention as claimed.

In accordance with this embodiment of the device 10" there are provided enhanced shelf areas 170 with increased material angular supports 172 undergirding the enhanced shelf areas to secure interconnection of the two identical chair members 10" in stacking relationship, one chair on top of another chair. The enhanced shelf areas 170 with increased material angular supports 172 undergirding the enhanced shelf areas enable enhanced support capability of the 10" for increased loads presented by the upper layer of reinforcing materials involved in stacking as described.

Figure 11:
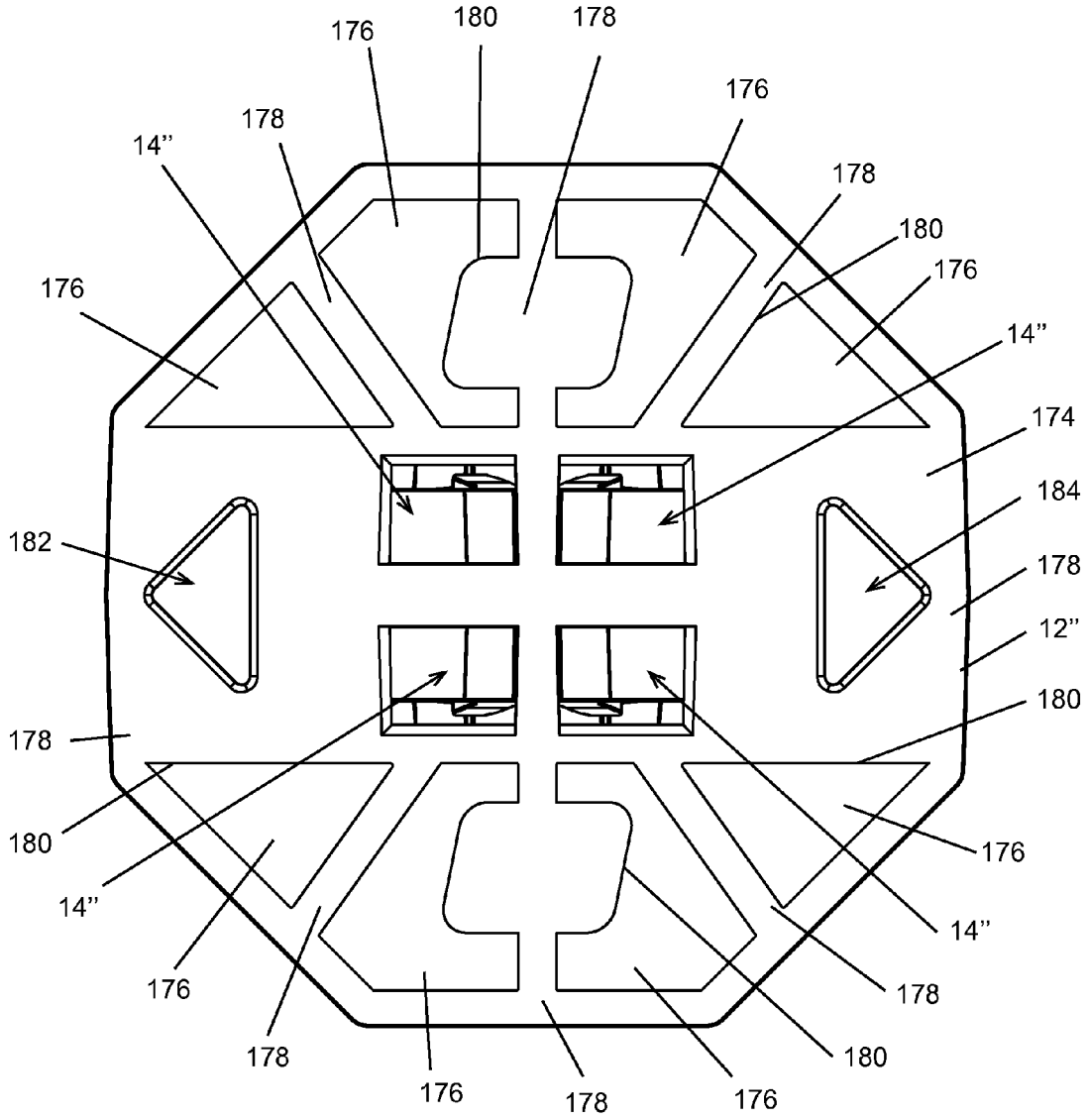
FIG. 11 is a bottom view of the multifunction concrete reinforcement support and tying device of FIG. 8.

Referring now to FIG. 11, the multifunction device 10"comprises an base member 12" having an underside surface 174 having partially hollowed-out portions 176 of the underside surface so as to reduce the amount of material necessary to make the device, and therefor to reduce the cost of production of the device. This is accomplished while still retaining sufficient rigidity and sturdiness of the device 10" relative to other embodiments associated with remaining thicker portions 178 of the base. The aforementioned feature also further facilitates secure placement of the device 10" on the ground or aggregate surface, since the ridge-like transition areas (e.g., 180) between the thicker and thinner portions of the underside surface serve to hold the device in place where it has been placed upon the ground or aggregate surface. This is accomplished in that the ridge-like transition areas dig into the surface when the heavy weight of the reinforcing materials is added to the chair, which in turn causes the edge-like features of the underside of the base of this embodiment of the invention to dig in slightly, or conform to and with the slightly deformable supporting surface, to create a more stable base for the resulting structure than has been achievable by prior art devices.

To further enhance the ease of use of the device 10", there are further provided in the octagonal base area 12" of the device a plurality of punched-through alignment guide arrows 182, 184 for guiding a user in the proper orientation of the device for placement on the ground. These punched-through arrows 182, 184 signify to the user the need to place the device 10" with the arrows oriented in parallel alignment to the longitudinal axis of the lower piece of rebar **8*a*" to be placed and held in the device. Further, in terms of aligning two devices 10" for easy stackability, the punched-through arrows 182, 184 also guide the user in aligning two identical devices for stacking. With the arrows 182, 184 of two devices 10" oriented in alignment, with one set of arrows above the other set of arrows, the devices are readily attachable. Thus, in the orientation wherein the arrows 182, 184 of each of the devices 10" are aligned with each other, with one device in such position able to be stacked on top of the other, as shown in FIG. 12, the user is thus guided in easily orienting the devices. This feature is important since it guides a user in quickly orienting two devices 10" to be stacked, or a single device to be used on a supporting surface, especially in the case where the user is called upon to install many such devices in a relatively short period of time. Since the devices 10" are relatively complex, and even similar looking in different orientations, the arrows 182, 184 help to speed up installation. If the arrows 182, 184 of two identical such multifunction devices 10" are oriented normal to each other, the devices will not readily attach to each other. Another function and advantage of these punched-through arrows 182, 184 is that they enable the concrete to flow through them. This minimizes the amount of material necessary to form the devices 10", thus allowing for greater structural integrity of the final pour of concrete, as well as a less costly chair to produce preferably with plastic injection molding manufacturing means. Thus, these punched-through arrows 182, 184** serve multiple purposes in facilitating manufacture and use of the invention.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A multifunction device stackable on an identical such multifunction device and adapted for releasably gripping and positioning one of reinforcing mesh wire having a first cross-section dimension and a plurality of other reinforcing materials of a second cross-section dimension comprising:

a base adapted for resting on a supporting surface, there being integrated into said base a plurality of receptacles adapted for stackably interconnecting the multifunction device with an identical such multifunction device and alignment guides facilitating alignment of the device with one of the reinforcing materials and the other identical such multifunction device;

a post having first and second ends and extending from said base at the first end, at least a portion of said post adjacent the second end defining in cross-section back-to-back E-shaped-beams;

a multifunction clip attached at the second end of said post and defining a first socket of a first dimension adapted for clipping onto and positioning of a reinforcing material of a first cross-section dimension a pre-determined distance above the supporting surface, the multifunction clip further defining a pair of orthogonally oriented sockets of a second dimension and adapted for connecting at right angles and positioning reinforcing materials having a corresponding second cross-section dimension a pre-determined distance above the supporting surface, the multifunction clip further defining a plurality of prongs adapted for being received and releasably retained in the receptacles of the base of the identical such multifunction device; and means for allowing biasing of said multifunction clip so that it is adapted for insertion and releasable retention of reinforcing materials.

2. The multifunction device of claim 1, wherein said post further comprises in cross-section back-to-back E-shaped beams forming an intersection with said base, wherein the thickness and width of said post are of a constant dimension for an upper portion of said post, and wherein the thickness and width of said post are of an increasing dimension from an intermediate point of said post extending to the intersection of said post with said base of the multifunction device.

3. The multifunction device of claim 2, wherein said base further comprises an octagonal shaped disk having four pairs of opposing parallel edges, wherein said back-to-back E-shaped beams intersect with said base forming linear intersections that are each parallel to two opposing edges of said base.

4. The multifunction device of claim 3, wherein the linear intersections are comprised of two outer parallel intersections, one inner parallel intersection and a perpendicular interconnecting intersection, wherein said alignment guides are interposed between each of the outer parallel intersections and their closest parallel edge portions of said octagonal base.

5. The multifunction device of claim 4, wherein said multifunction clip further comprises a saddle portion attached at the second end of said post, wherein said multifunction clip further comprises a plurality of uprights extending away from the saddle portion and the post, the uprights of said multifunction clip defining the first and second sockets, and wherein said means for allowing biasing of said clip further comprises a hole defined adjacent the saddle portion of said multifunction clip for allowing the uprights to be adapted for being forced outwardly from a pre-installation first position to a second position during installation where the uprights are spread sufficiently during receipt of a reinforcing element, the uprights being adapted for resuming the pre-installation first position around the reinforcing element as the reinforcing element becomes fully positioned within the socket formed by the uprights during installation.

* * * * *